US010875091B2

(12) United States Patent
Lee et al.

(10) Patent No.: US 10,875,091 B2
(45) Date of Patent: Dec. 29, 2020

(54) METAL POWDER, FEEDSTOCK, AND PREPARATION METHOD THEREFOR

(71) Applicant: INDUSTRY-UNIVERSITY COOPERATION FOUNDATION HANYANG UNIVERSITY ERICA CAMPUS, Ansan-si (KR)

(72) Inventors: Jaisung Lee, Seoul (KR); Wookyung You, Seoul (KR)

(73) Assignees: INDUSTRY-UNIVERSITY COOPERATION FOUNDATION, Ansan-si (KR); HANYANG UNIVERSITY ERICA CAMPUS, Gyeonggi-do (KR)

( * ) Notice: Subject to any disclaimer, the term of this patent is extended or adjusted under 35 U.S.C. 154(b) by 305 days.

(21) Appl. No.: 15/533,062

(22) PCT Filed: Apr. 1, 2015

(86) PCT No.: PCT/KR2015/003244
§ 371 (c)(1),
(2) Date: Jun. 5, 2017

(87) PCT Pub. No.: WO2016/088947
PCT Pub. Date: Jun. 9, 2016

(65) Prior Publication Data

US 2017/0326641 A1 Nov. 16, 2017

(30) Foreign Application Priority Data

Dec. 5, 2014 (KR) ..... 10-2014-0174115
Mar. 18, 2015 (KR) ..... 10-2015-0037564

(51) Int. Cl.
*B22F 1/00* (2006.01)
*B22F 9/04* (2006.01)
(Continued)

(52) U.S. Cl.
CPC ..... *B22F 1/0096* (2013.01); *B22F 1/0011* (2013.01); *B22F 1/0062* (2013.01);
(Continued)

(58) Field of Classification Search
None
See application file for complete search history.

(56) References Cited

U.S. PATENT DOCUMENTS 3,627,862 A * 12/1971 West ..... B22F 9/04 264/71
5,135,566 A * 8/1992 Sakuranda ..... B22F 1/0059 75/246
(Continued)

FOREIGN PATENT DOCUMENTS

JP 2004076153 A 3/2004
JP 2007302911 A * 11/2007
(Continued)

OTHER PUBLICATIONS

European Patent Office machine translation of KR 2013-0109325 (Year: 2013).*
(Continued)

*Primary Examiner* — Colleen P Dunn
*Assistant Examiner* — Michael J Kachmarik
(74) *Attorney, Agent, or Firm* — Finch & Maloney PLLC

(57) ABSTRACT

A method for manufacturing metal powder is provided. The method includes preparing first metal powder, agglomerating the first metal powder to manufacture second metal powder in which the first metal powder is agglomerated, coating the second metal powder with an organic binder, and agglomerating and coarsening the second metal powder coated with the organic binder to manufacture third metal powder having higher flowability than the second metal powder coated with the organic binder.

6 Claims, 18 Drawing Sheets

(51) Int. Cl.

| | |
|---|---|
| ***B22F 9/20*** | (2006.01) |
| ***B22F 3/16*** | (2006.01) |
| ***B22F 3/22*** | (2006.01) |
| ***B22F 9/08*** | (2006.01) |

(52) U.S. Cl.
CPC ..... *B22F 1/0085* (2013.01); *B22F 3/16* (2013.01); *B22F 3/225* (2013.01); *B22F 9/04* (2013.01); *B22F 9/082* (2013.01); *B22F 9/20* (2013.01); *B22F 2009/0828* (2013.01); *B22F 2998/10* (2013.01); *B22F 2999/00* (2013.01)

(56) References Cited

U.S. PATENT DOCUMENTS

| | | | | |
|---|---|---|---|---|
| 6,444,167 | B1 | 9/2002 | Shimodaira et al. | |
| 7,604,678 | B2 * | 10/2009 | Poszmik | B22F 1/02 75/231 |
| 7,666,247 | B2 | 2/2010 | He | |
| 2001/0028859 | A1 * | 10/2001 | Ozaki | B22F 1/0059 419/35 |
| 2008/0286141 | A1 * | 11/2008 | Lee | B22F 1/0018 419/23 |
| 2010/0284239 | A1 * | 11/2010 | Maeda | B22F 1/0077 366/144 |
| 2017/0209925 | A1 * | 7/2017 | Kataoka | B22F 9/04 |

FOREIGN PATENT DOCUMENTS

| | | | |
|---|---|---|---|
| JP | 2007302911 | A | 11/2007 |
| JP | 2010001516 | A | 1/2010 |
| KR | 1020010093440 | A | 10/2001 |
| KR | 1020090084092 | A | 8/2009 |
| KR | 100995772 | B1 | 11/2010 |
| KR | 20130109325 | A * | 10/2013 |
| KR | 1020130109325 | A | 10/2013 |

OTHER PUBLICATIONS

European Patent Office machine translation of JP 2007-302911 (Year: 2007).*
B. H. Kaye, Handbook of powder science & technology, Springer, copyright 1997, pertinent pages chp 6 202-377, (Year: 1997).*
Republic of Korea Patent Application 10-2004-0057701 (filed Jul. 23, 2004).

* cited by examiner

[FIG. 1]
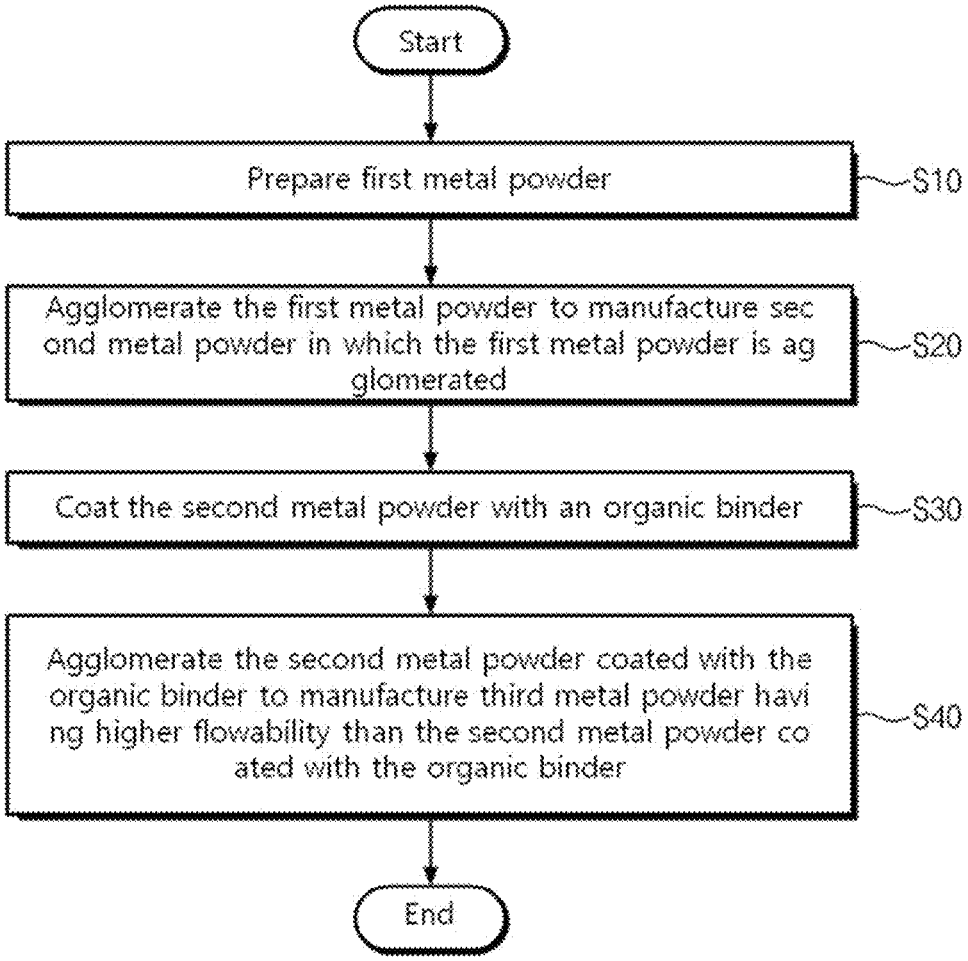
[FIG. 2]
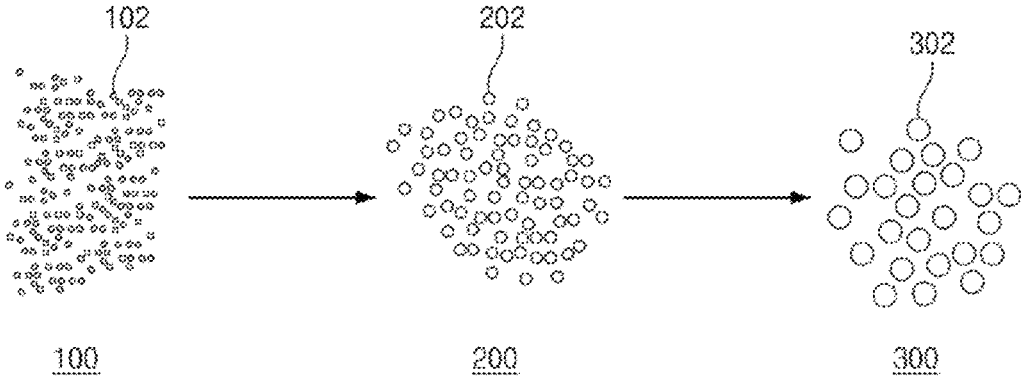

[FIG. 3]
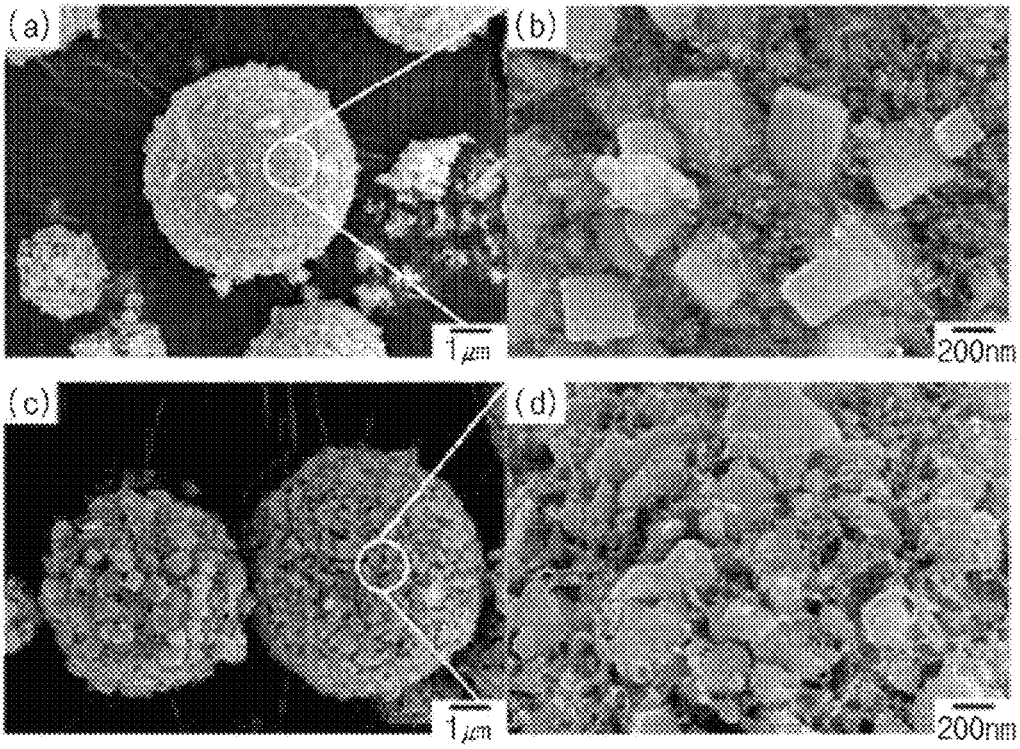

[FIG. 4]
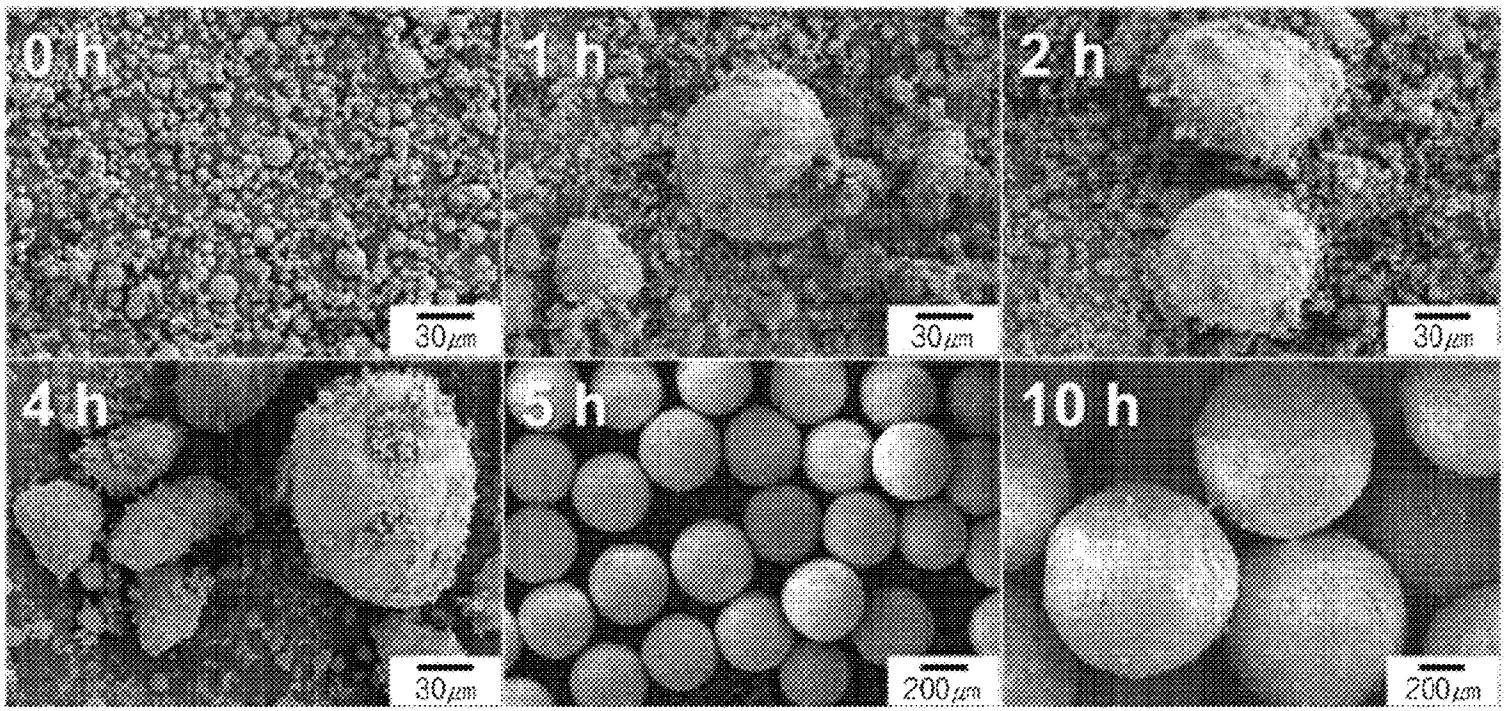

【FIG. 5a】
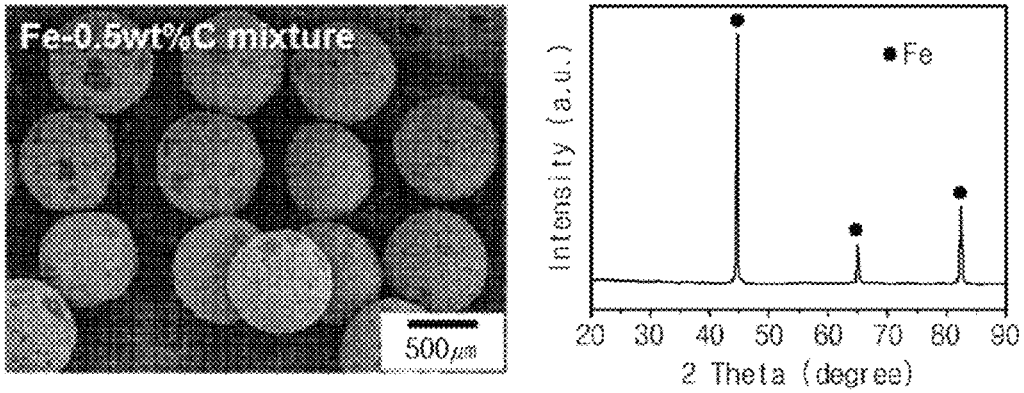
【FIG. 5b】
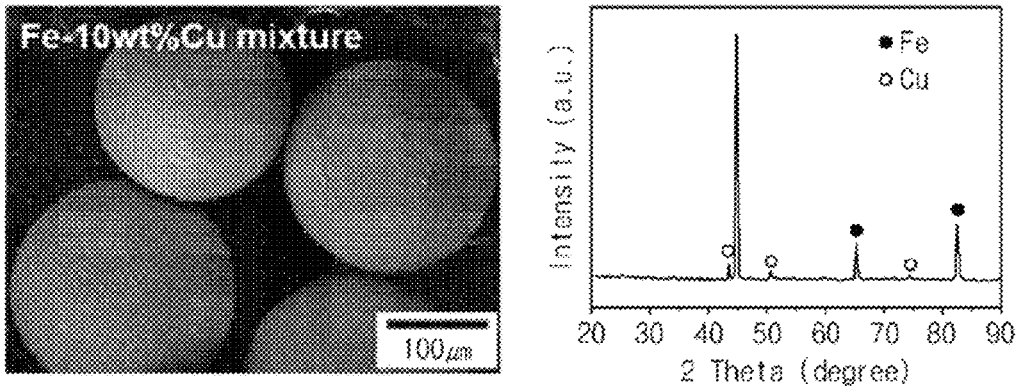
【FIG. 5c】
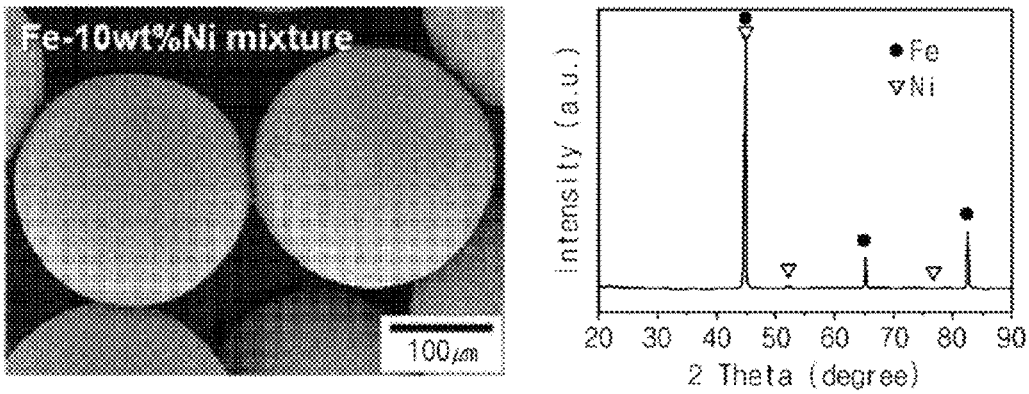

[FIG. 6]
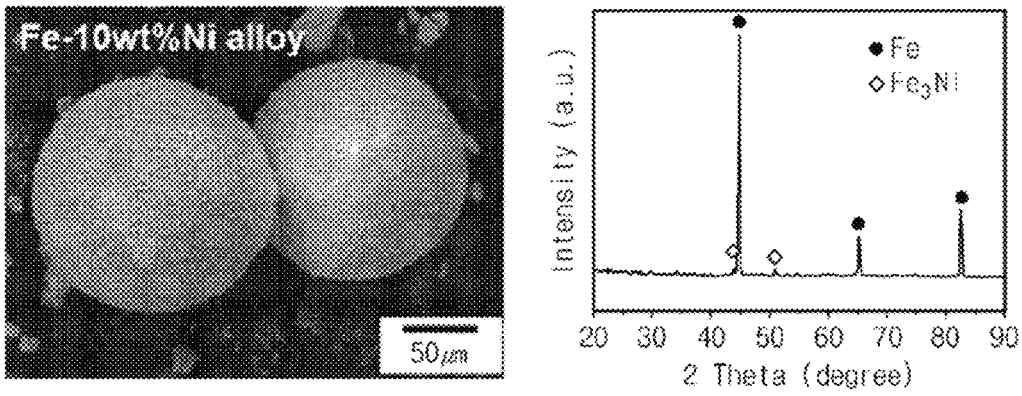
[FIG. 7]
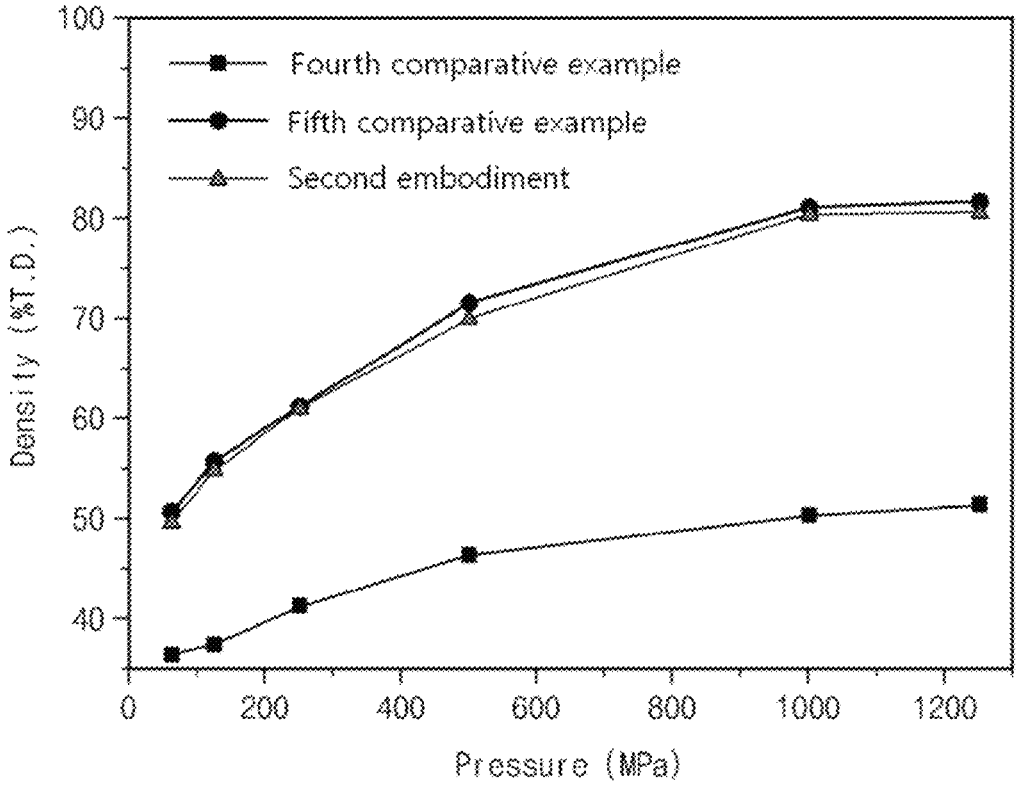

[FIG. 8]
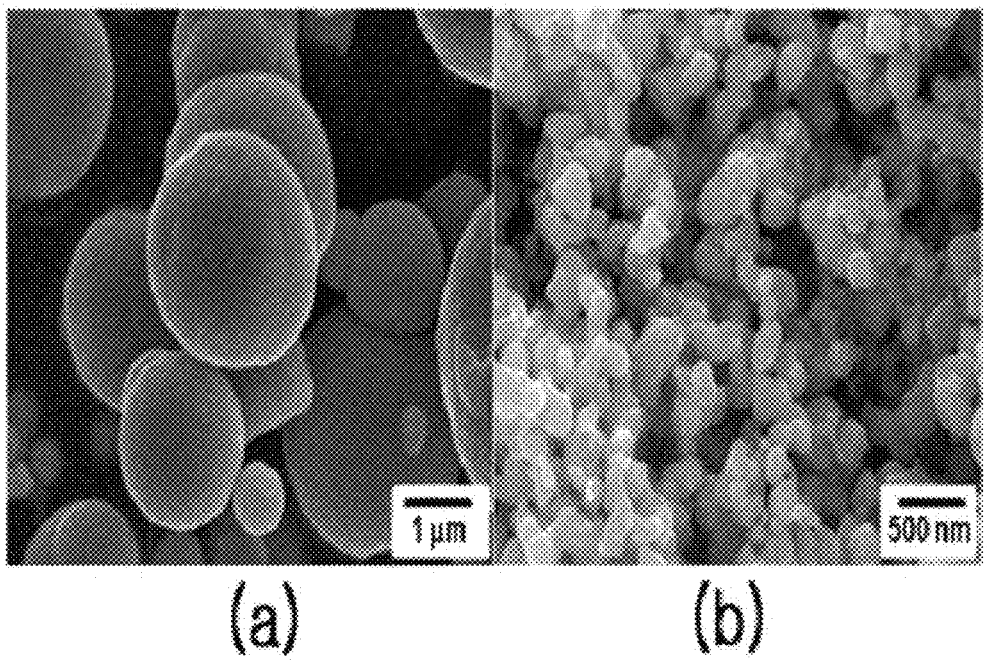
[FIG. 9]
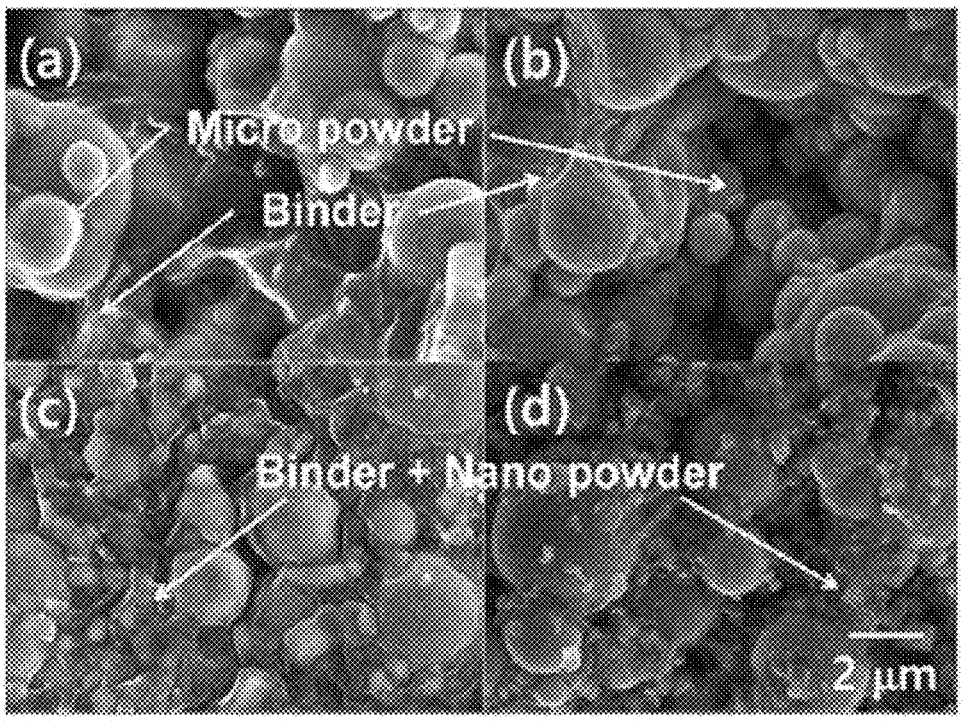

[FIG. 10]
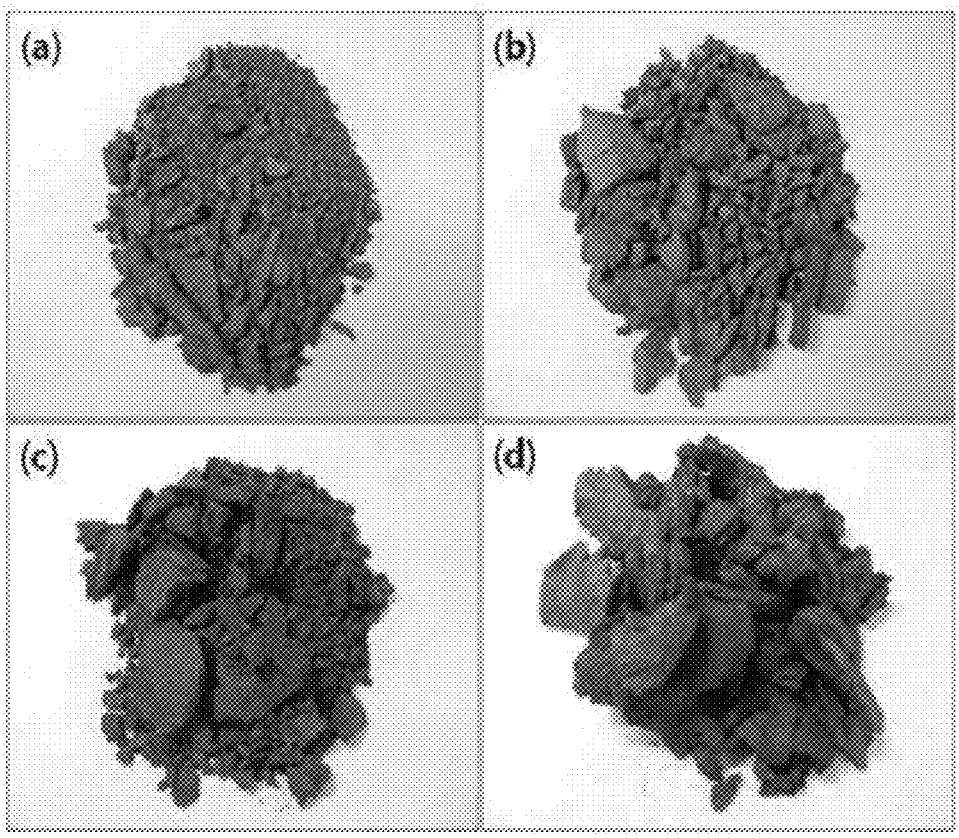

[FIG. 11]
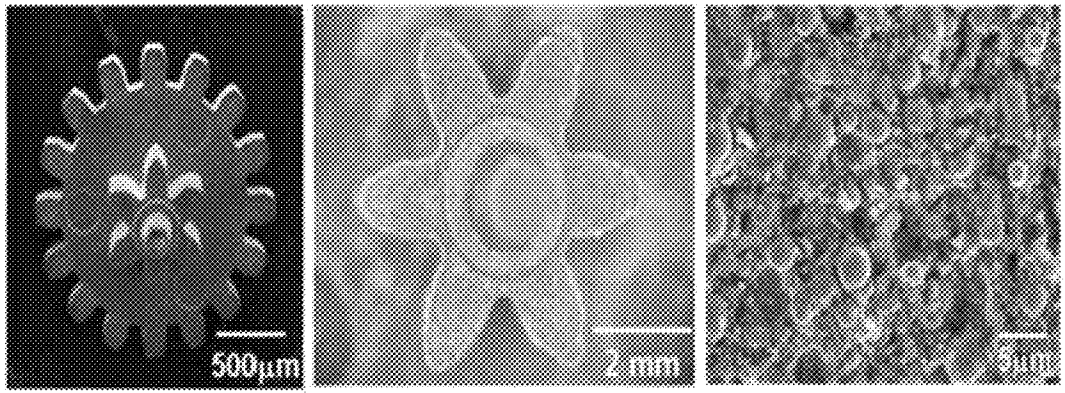

【FIG. 12】
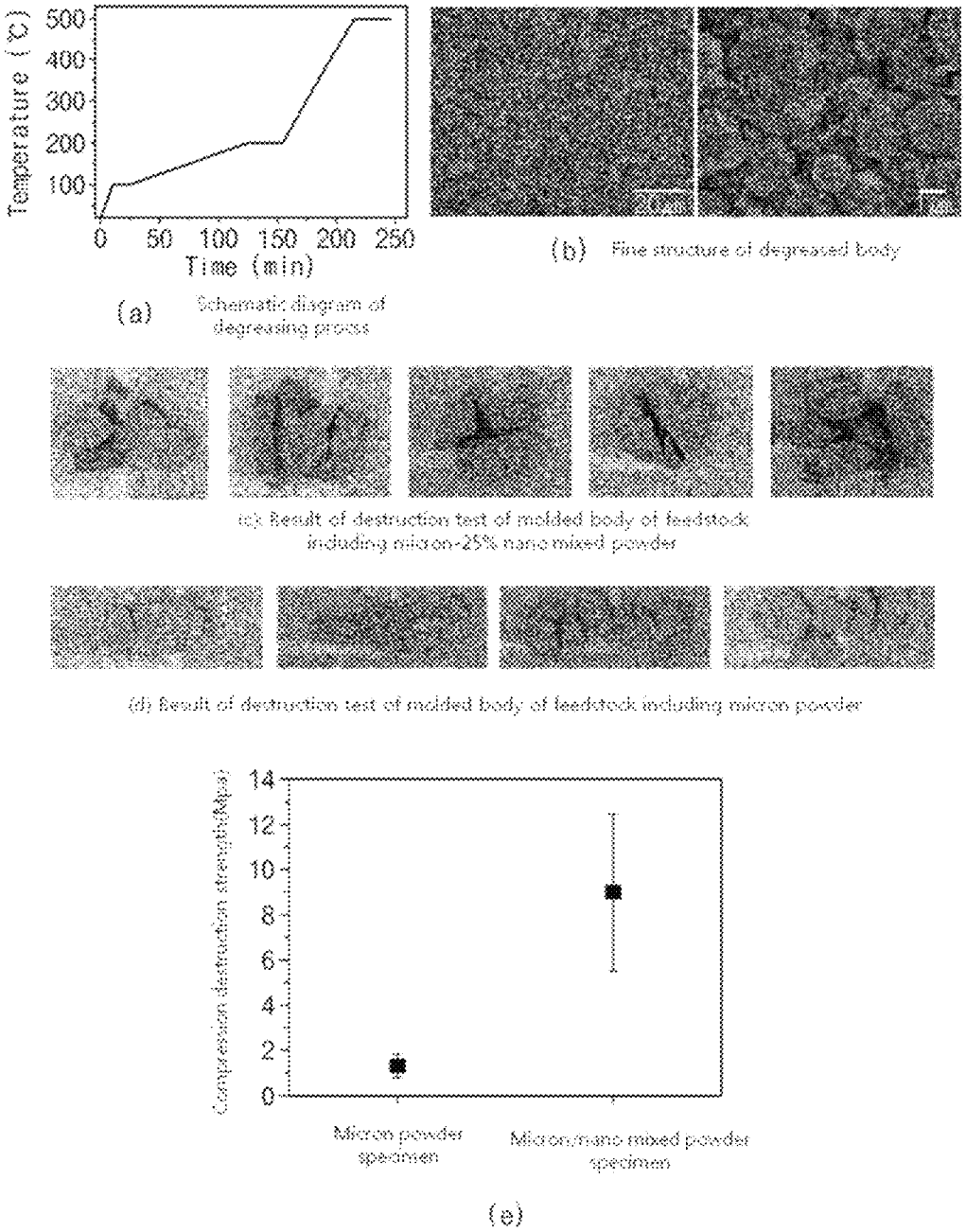

[FIG. 13]
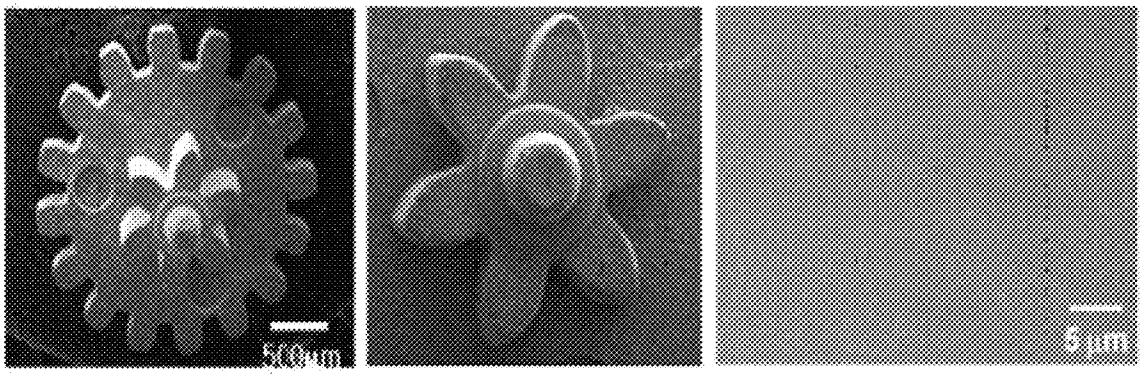

[FIG. 14]
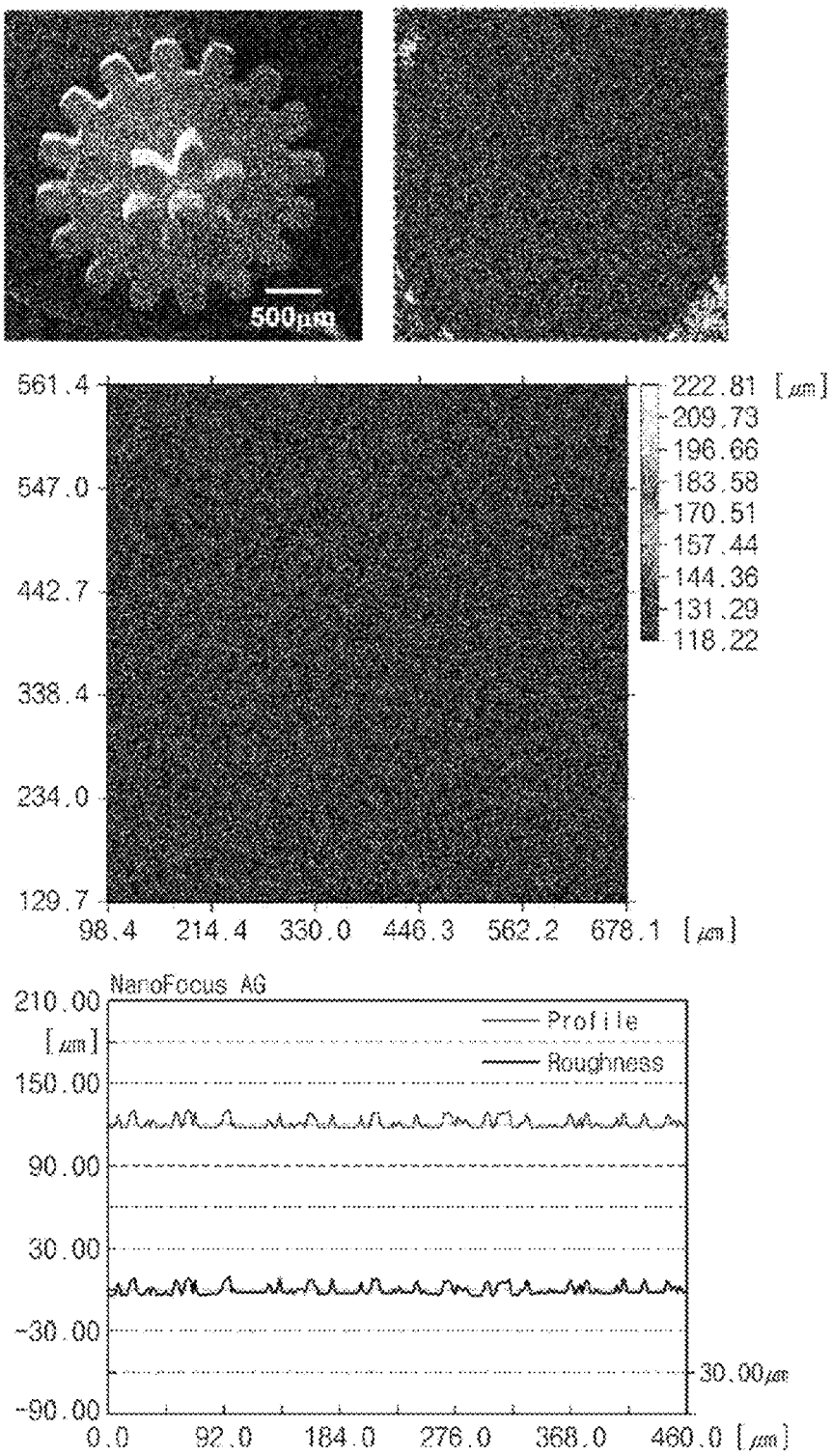

【FIG. 15】
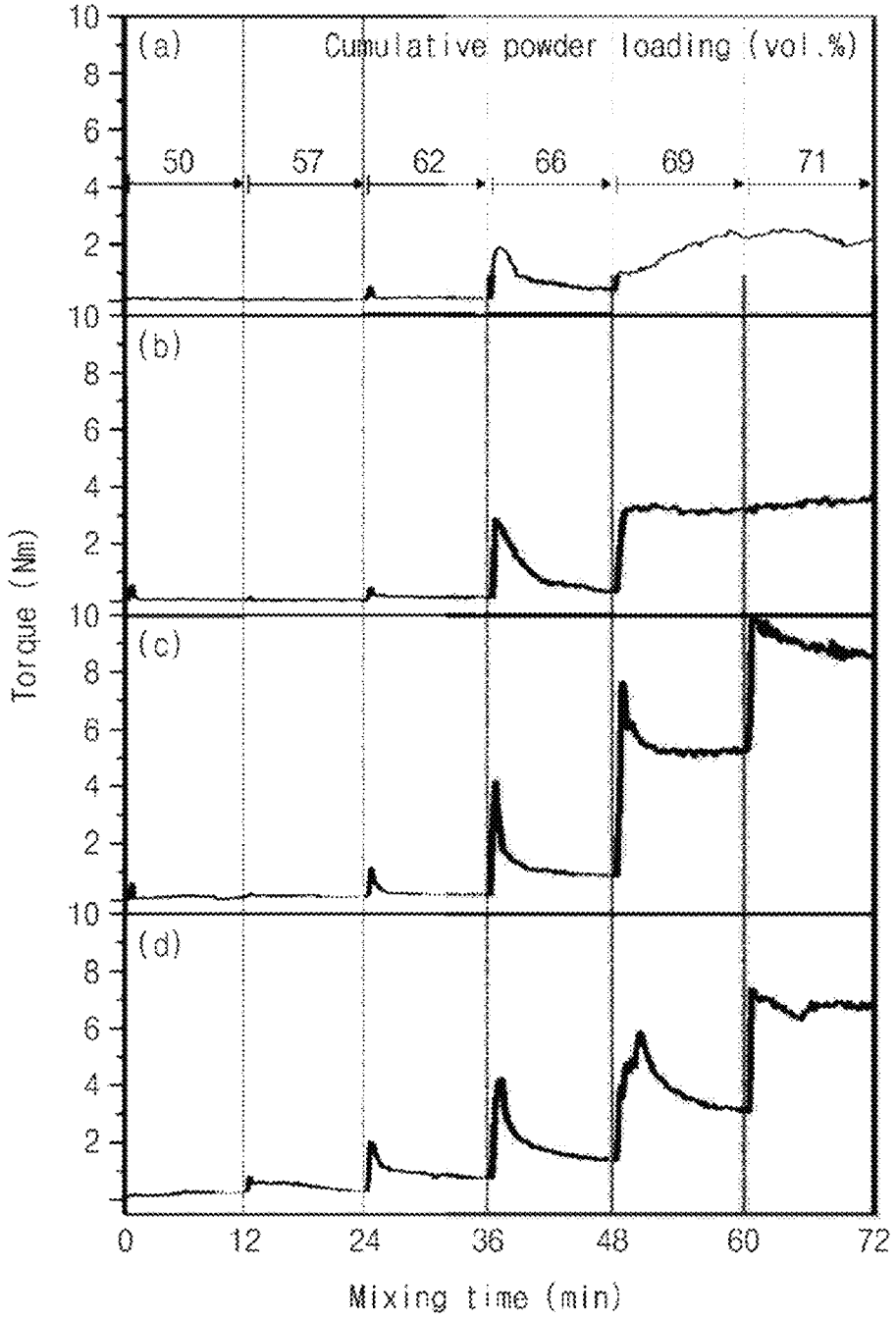

[FIG. 16]
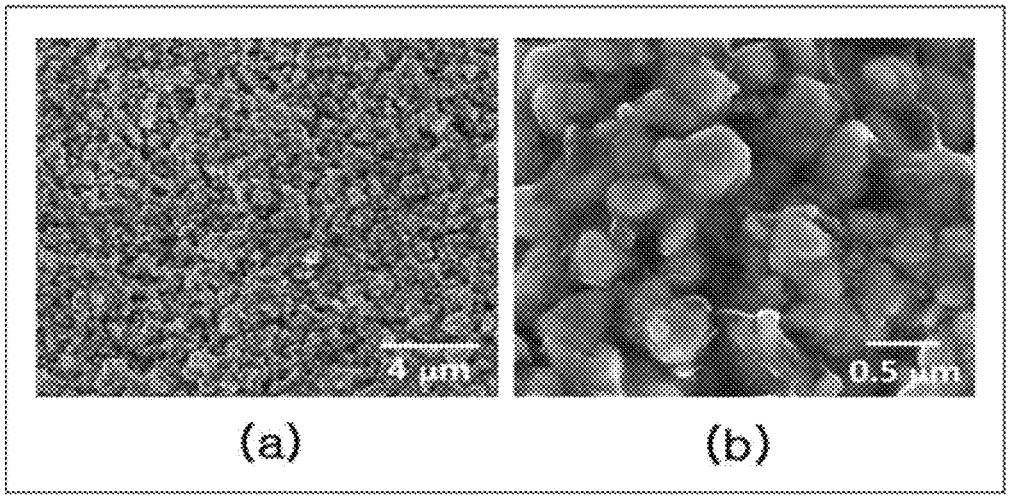
[FIG. 17]
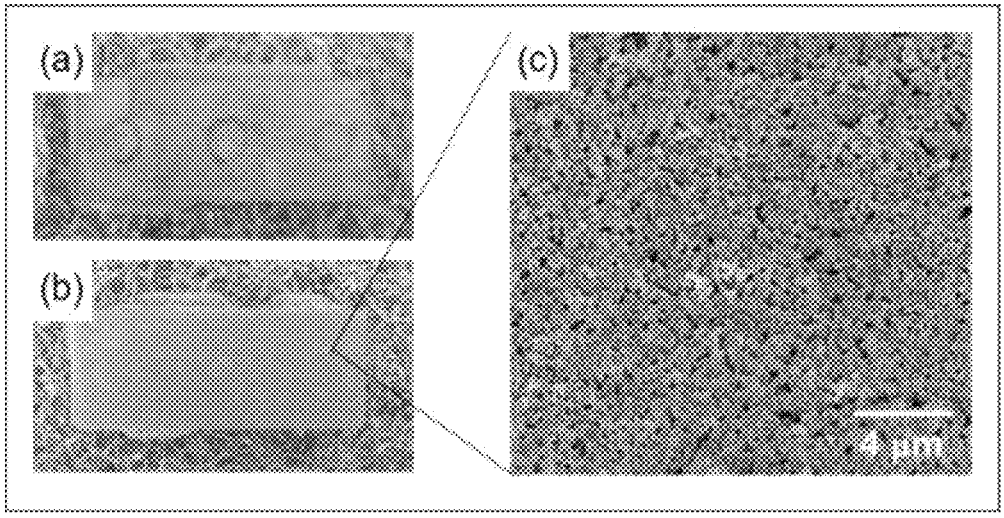

[FIG. 18]
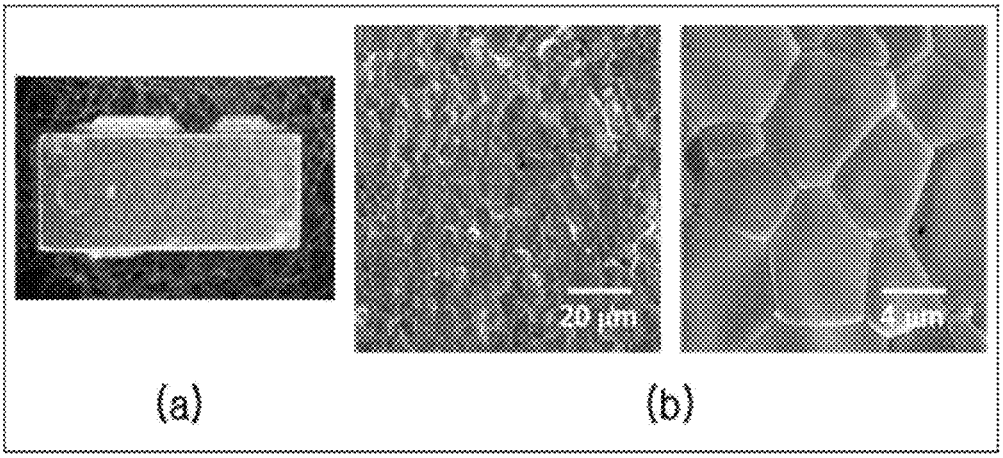
[FIG. 19]
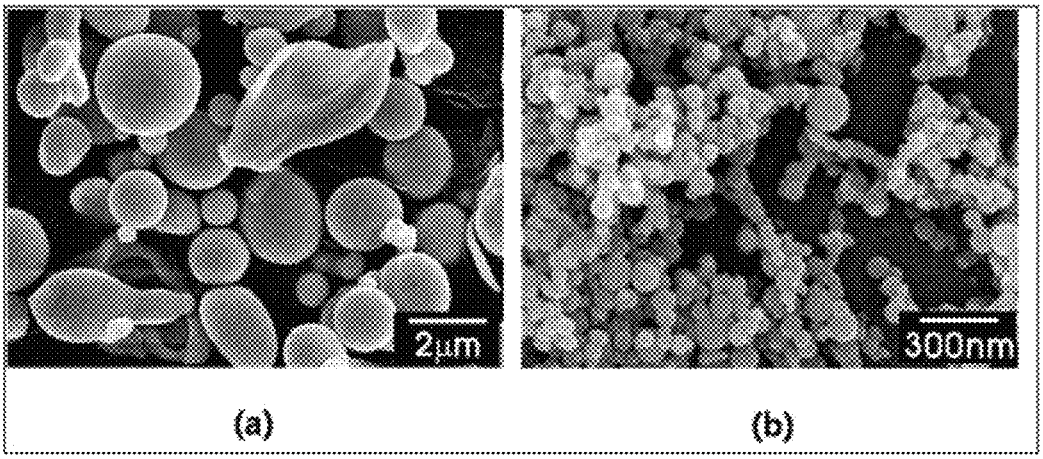

[FIG. 20]
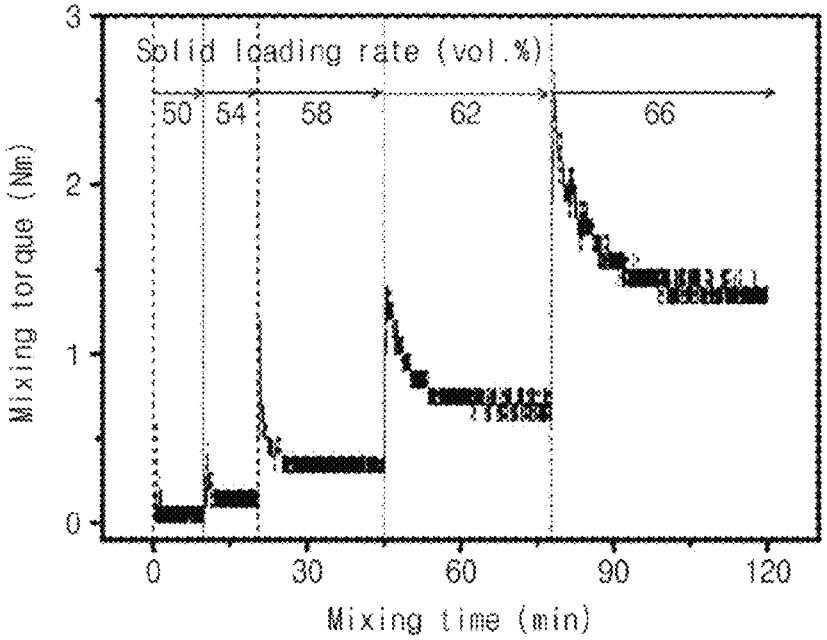
(a)
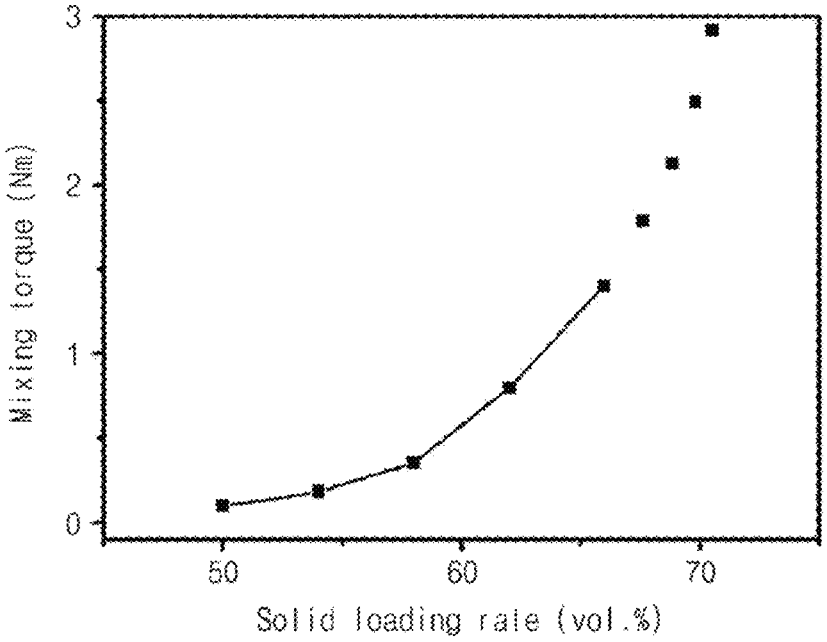
(b)

[FIG. 21]
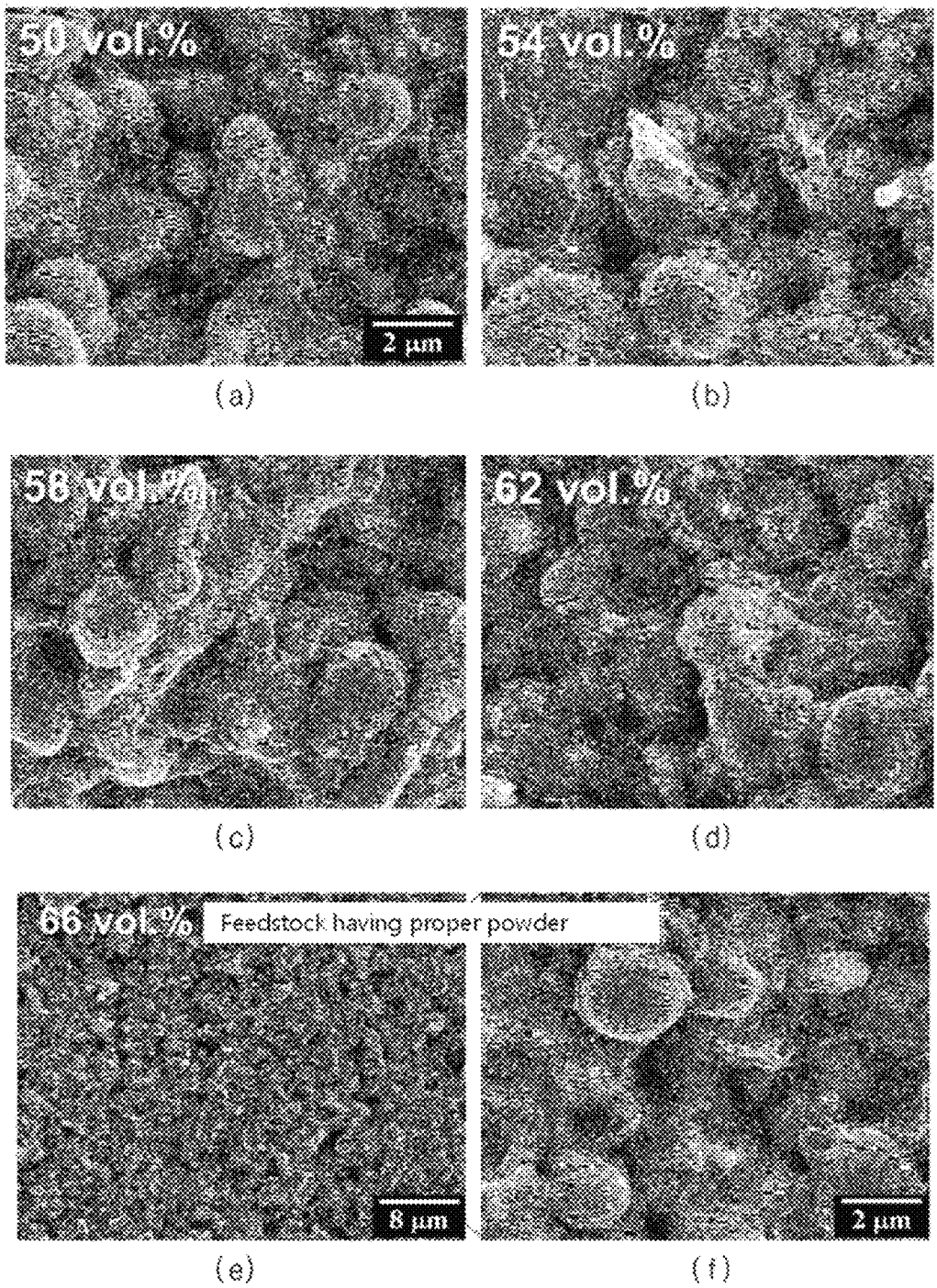

[FIG. 22]
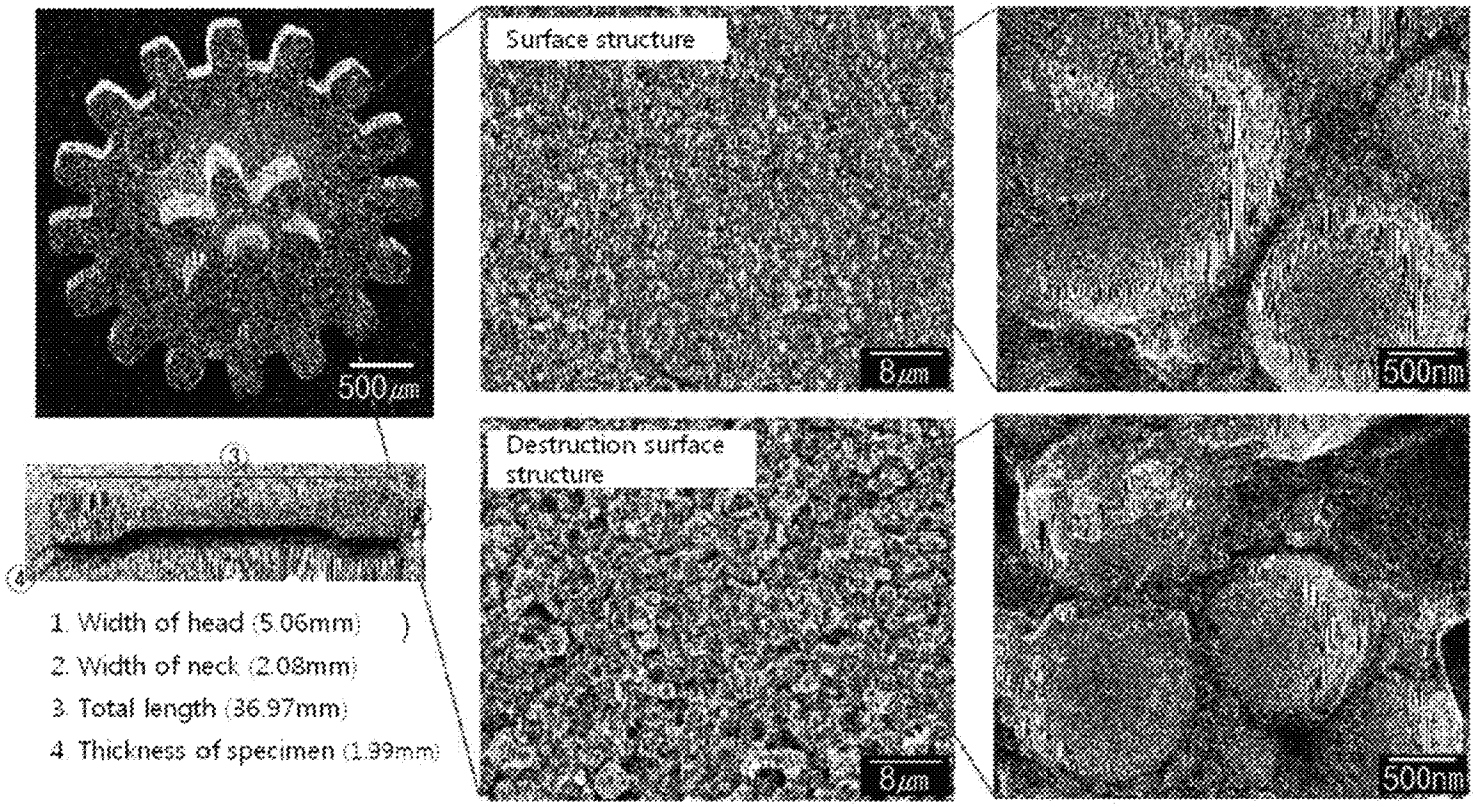

[FIG. 23]
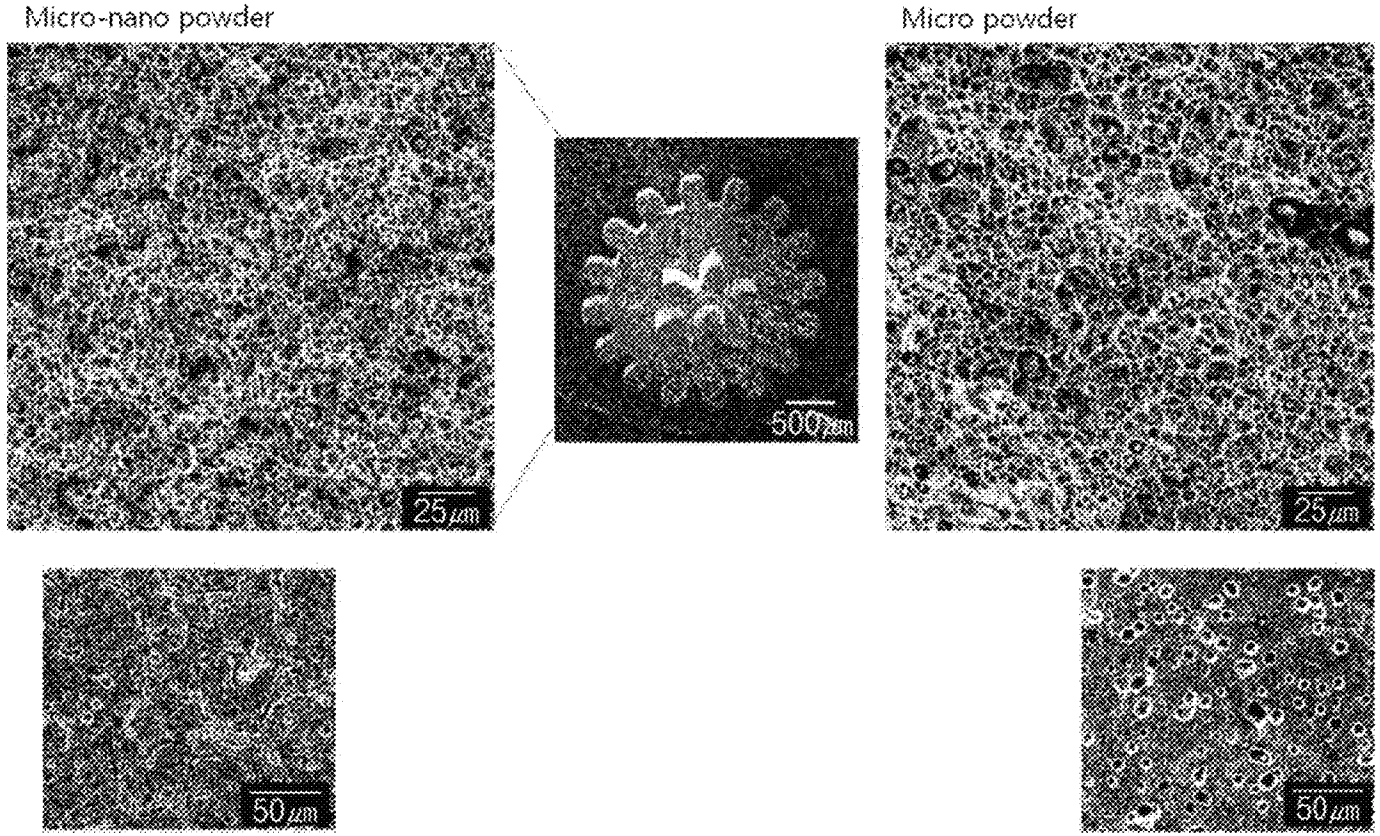

METAL POWDER, FEEDSTOCK, AND PREPARATION METHOD THEREFOR

BACKGROUND

1. Field

Embodiments of the inventive concepts relate to metal powder, a method for manufacturing the same, and a method for manufacturing a molded product using the same and, more particularly, to metal powder having high flowability and high moldability, a method for manufacturing the same, and a method for manufacturing a molded product using the same.

In addition, embodiments of the inventive concepts relate to feedstock for powder injection molding and, more particularly, to feedstock used when powder injection molding is performed at low temperature and low pressure for processing of ultra-small precision machinery parts.

2. Description of the Related Art

Metal powder having a micro/nano size is attractive as a next-generation component material capable of achieving weight reduction, miniaturization and high strength required by a parts industry due to its excellent physical and chemical characteristics realized by a fine particle size thereof.

For example, Korean Patent Publication No. 10-2001-0032240 (Application No. 10-2000-7005441, Applicant: SEIKO EPSON CORPORATION) discloses a method for manufacturing a metal powder injection-molded product. In the method, an undercut is formed in an injection-molded product formed by injection-molding a mixture including metal powder and a binder resin, and the injection-molded product having the undercut is degreased and then sintered.

However, fine metal powder having a micro/nano size may be explosively oxidized due to its wide specific surface area, and an irregular agglomeration phenomenon may be occur in the metal powder due to frictional force between particles of the metal powder. The fine metal powder having the micro/nano size may have low flowability due to these characteristics, and thus it may be difficult to handle the metal powder and to transfer the metal powder in manufacturing of parts through a powder metallurgy process. In addition, due to the low flowability of the metal powder, it may not be easy to provide the metal powder into a die during die molding. Moreover, due to low moldability of the metal powder, it may not be easy to manufacture a molded product using the metal powder. Furthermore, dimensional stability of the molded product may be low due to non-uniformity of density and high shrinkage in the molded product.

Thus, research and development are needed to improve the flowability and moldability of fine metal powder having a micro/nano size.

Powder injection molding (PIM) is a technique that manufactures parts having a thread shape by using feedstock that is a thermoplastic mixture including metal or ceramic powder and a binder.

Generally, the powder injection molding (PIM) may easily mass-produce complex-shaped parts and may have few restrictions on used materials. In addition, the powder injection molding (PIM) may allow final parts to have excellent tolerances and mechanical characteristics. Thus, in recent years, micro powder injection molding techniques have been actively studied for manufacturing ultra-small parts of 1 mm or less required in high-tech industries.

In particular, in the powder injection molding for manufacturing ultra-small parts, the development of the feedstock having both flowability and moldability is important in manufacturing of final parts.

Application of conventional feedstock to powder injection molding for manufacturing ultra-small parts may cause great technical and economic problems. For example, when nano powder is used, a molding operation may be difficult by a sharp increase in molding pressure in injection molding since a surface area of the nano powder is large. In addition, since ultra-small parts have ultra-small sizes and are delicate, powder injection molding should be performed at low temperature or pressure. However, it may not be easy to perform molding at low temperature and low pressure.

Therefore, to manufacture ultra-small parts, there is a need for feedstock capable of being easily injection-molded at low temperature and low pressure.

SUMMARY

Embodiments of the inventive concepts may provide metal powder with improved flowability and a method for manufacturing the same.

Embodiments of the inventive concepts may also provide metal powder with improved moldability and a method for manufacturing the same.

Embodiments of the inventive concepts may further provide highly reliable metal powder, a method for manufacturing the same, and a method for manufacturing a molded product using the same.

Embodiments of the inventive concepts may further provide metal powder capable of being handled in the atmosphere and a method for manufacturing the same.

Embodiments of the inventive concepts may further provide metal powder capable of improving uniformity of a density of a molded product and a method for manufacturing the same.

Embodiments of the inventive concepts may further provide feedstock that can be used in low-temperature and low-pressure powder injection molding by using raw material powder and a binder having low melting point and low viscosity, and a method for manufacturing the same.

In an aspect, a method for manufacturing metal powder may include preparing first metal powder, agglomerating the first metal powder to manufacture second metal powder in which the first metal powder is agglomerated, coating the second metal powder with an organic binder, and agglomerating and coarsening the second metal powder coated with the organic binder to manufacture third metal powder having higher flowability than the second metal powder coated with the organic binder.

In some embodiments, the agglomerating of the second metal powder may include mechanically mixing the second metal powder.

In some embodiments, the method may further include thermally treating the third metal powder to increase agglomeration strength of the third metal powder.

In some embodiments, the third metal powder may be thermally treated at a melting point of the organic binder.

In some embodiments, a size of the third metal powder may increase as a time of the mechanical mixing of the second metal powder increases.

In some embodiments, a maximum value of a diameter of the third metal powder may be 800 μm.

In some embodiments, a Hausner ratio of the third metal powder may be 1.1 or less.

In some embodiments, the agglomerating of the second metal powder to manufacture the third metal powder may include adding additive powder, which includes an additive element different from a metal included in the second metal powder, to the second metal powder, and agglomerating the second metal powder and the additive powder.

In some embodiments, the preparing of the first metal powder may include preparing a metal oxide, and pulverizing the metal oxide to manufacture the first metal powder. The agglomerating of the first metal powder to manufacture the second metal powder may include agglomerating the first metal powder manufactured by pulverizing the metal oxide, and reducing the first metal powder agglomerated.

In an aspect, a method for manufacturing a molded product may include manufacturing metal powder by the aforementioned method for manufacturing metal powder, and manufacturing a molded product using the metal powder.

In an aspect, metal powder may include a third metal particle manufactured by agglomerating and coarsening second metal particles of which each is manufactured by agglomerating first metal particles. A diameter of the third metal particle may range from 100 μm to 800 μm, and a Hausner ratio of the third metal particle may be 1.1 or less.

In some embodiments, the third metal particle may include: a metal; and an additive element which is not combined with the metal but is mixed with the metal.

In some embodiments, the third metal particle may include: a metal; and an additive element chemically combined with the metal.

In an aspect, a method for manufacturing an injection molded body using feedstock may include preparing micron powder and sub-micron powder smaller in size than the micron powder, preparing a wax-based binder, manufacturing feedstock by mixing the micron powder, the sub-micron powder, and the wax-based binder with each other, manufacturing a molded part by performing a powder injection molding process using the feedstock, performing necking of the sub-micron powder included in the molded part and degreasing of the molded part at the same time, and sintering the molded part.

In some embodiments, strength of the molded part may be increased by the necking of the sub-micron powder included in the molded part.

In some embodiments, the manufacturing of the feedstock and the manufacturing of the molded part may be performed at the same temperature.

In some embodiments, the manufacturing of the feedstock and the manufacturing of the molded part may be performed at the same pressure.

In some embodiments, the micron powder may include metal carbonyl powder, and the sub-micron powder may include powder including a metal element which is the same as a metal element included in the micron powder.

In some embodiments, the preparing of the micron powder may include manufacturing the micron powder by a water atomizing method, and the preparing of the sub-micron powder may include manufacturing the sub-micron powder by a pulsed wire evaporation method.

In some embodiments, the manufacturing of the feedstock may include adding a surfactant to the micron powder, the sub-micron powder, and the wax-based binder.

In an aspect, a method for manufacturing an injection molded body using feedstock may include preparing micron powder and sub-micron powder smaller in size than the micron powder, preparing a wax-based binder, manufacturing feedstock by mixing the micron powder, the sub-micron powder, and the wax-based binder with each other at a first temperature, and manufacturing a molded part by performing a powder injection molding process using the feedstock at the first temperature.

In some embodiments, the first temperature may be lower than a melting point of the wax-based binder.

In some embodiments, the manufacturing of the feedstock and the manufacturing of the molded part may be performed at the same pressure.

In an aspect, a method for manufacturing feedstock for powder injection molding may include preparing micron powder and sub-micron powder smaller in size than the micron powder, preparing a wax-based binder, and mixing the micron powder, the sub-micron powder, and the wax-based binder with each other at a temperature lower than a melting point of the wax-based binder.

In some embodiments, the mixing of the micron powder, the sub-micron powder, and the wax-based binder may be performed at 70 degrees Celsius.

BRIEF DESCRIPTION OF THE DRAWINGS

FIG. 1 is a flowchart illustrating a method for manufacturing metal powder according to some embodiments of the inventive concepts.

FIG. 2 is a view illustrating metal powder and a method for manufacturing the same, according to some embodiments of the inventive concepts.

FIG. 3 shows images for explaining metal powder manufactured by a manufacturing method according to some embodiments of the inventive concepts.

FIG. 4 shows images for explaining a change in size according to an agglomerating process time in a method for manufacturing metal powder according to some embodiments of the inventive concepts.

FIGS. 5A to 5C show images and X-ray diffraction analysis graphs of coarsened mixed powder manufactured by a method for manufacturing metal powder according to some embodiments of the inventive concepts.

FIG. 6 shows an image and an X-ray diffraction analysis graph of coarsened alloy powder manufactured by a method for manufacturing metal powder according to some embodiments of the inventive concepts.

FIG. 7 is a graph showing measured molding densities of metal powder according to some embodiments of the inventive concepts.

FIG. 8 shows images of a fine structure of raw material powder of a seventh embodiment.

FIG. 9 shows images of a fine structure of feedstock of the seventh embodiment.

FIG. 10 shows images of feedstock in a powder form according to the seventh embodiment.

FIG. 11 shows images after injection molding of the feedstock according to the seventh embodiment.

FIG. 12 shows (a) a temperature-time graph of a degreasing process, (b) structures after the degreasing process, (c) and (d) compression destruction images of molded bodies after the degreasing process, and (e) compressive strength of the molded bodies after the degreasing process in the seventh embodiment.

FIG. 13 shows part images and a fine structure image after a sintering process in the seventh embodiment.

FIG. 14 shows part images and results of surface roughness after the sintering process in the seventh embodiment.

FIG. 15 is a graph showing a change behavior of torque when feedstock is mixed in the seventh embodiment.

FIG. 16 shows images of a W—Cu fine structure according to an eighth embodiment.

FIG. 17 shows images after molding and after degreasing in the eighth embodiment.

FIG. 18 shows images after sintering in the eighth embodiment.

FIG. 19 shows electron microscope images of micron powder and nano powder in a ninth embodiment.

FIG. 20 shows (a) a graph of behavior of a mixing torque to a mixing time and (b) a graph of behavior of a mixing torque to a powder content in the ninth embodiment.

FIG. 21 shows electron microscope images of destruction surface structures of feedstock according to a raw material powder content in the ninth embodiment ((a): 50 vol. %, (b) 54 vol. %, (c) 58 vol. %, (d) 62 vol. %, and (e) and (f) 66 vol. %).

FIG. 22 shows images of a surface structure of a molded product having a gear shape and a destruction surface structure of a molded product having a tensile specimen shape when feedstock of the ninth embodiment is injection-molded.

FIG. 23 shows electron microscope images of fine structures of micron powder and micron-nano powder after injection-molded products are sintered in the ninth embodiment.

DETAILED DESCRIPTION OF THE EMBODIMENTS

The inventive concepts will now be described more fully hereinafter with reference to the accompanying drawings, in which exemplary embodiments of the inventive concepts are shown. It should be noted, however, that the inventive concepts are not limited to the following exemplary embodiments, and may be implemented in various forms. Accordingly, the exemplary embodiments are provided only to disclose the inventive concepts and let those skilled in the art know the category of the inventive concepts.

It will be also understood that although the terms first, second, third etc. may be used herein to describe various elements, these elements should not be limited by these terms. These terms are only used to distinguish one element from another element. Thus, a first element in some embodiments could be termed a second element in other embodiments without departing from the teachings of the present invention. Exemplary embodiments of aspects of the present inventive concepts explained and illustrated herein include their complementary counterparts. As used herein, the term "and/or" includes any and all combinations of one or more of the associated listed items.

The terminology used herein is for the purpose of describing particular embodiments only and is not intended to limit the invention. As used herein, the singular terms "a", "an" and "the" are intended to include the plural forms as well, unless the context clearly indicates otherwise. It will be further understood that the terms "comprises", "comprising", "includes", "including", "have", "has" and/or "having" when used herein, specify the presence of stated features, integers, steps, operations, elements, and/or components, but do not preclude the presence or addition of one or more other features, integers, steps, operations, elements, components, and/or groups thereof. Furthermore, it will be understood that when an element is referred to as being "connected" or "coupled" to another element, it may be directly connected or coupled to the other element or intervening elements may be present.

In addition, in explanation of the present invention, the descriptions to the elements and functions of related arts may be omitted if they obscure the subjects of the inventive concepts.

Furthermore, in the present specification, a metal particle and metal powder may mean a particle and powder that include a material including a metal, such as a metal oxide, a metal nitride, a metal oxynitride, or a metal carbide. Furthermore, in the present specification, the metal particle and the metal powder may mean a particle and powder that include a single kind of a metal or a plurality of kinds of metals.

FIG. 1 is a flowchart illustrating a method for manufacturing metal powder according to some embodiments of the inventive concepts, and FIG. 2 is a view illustrating metal powder and a method for manufacturing the same, according to some embodiments of the inventive concepts.

Referring to FIGS. 1 and 2, first metal powder 100 having first metal particles 102 is prepared (S10). The first metal particle 102 may have a nano size. For example, a diameter of the first metal particle 102 may be 100 nm or less. The first metal particle 102 may include at least one of iron (Fe), tungsten (W), copper (Cu), nickel (Ni), molybdenum (Mo), or chromium (Cr).

In some embodiments, the preparation of the first metal powder 100 may include preparing a metal oxide and pulverizing the metal oxide to form the first metal powder 100. In some embodiments, the metal oxide may be pulverized by a mechanical pulverization method (e.g., a ball-milling method).

Alternatively, in certain embodiments, the preparation of the first metal powder 100 may include preparing the metal oxide and an additive, and mixing and pulverizing the metal oxide and the additive. In this case, the first metal powder 100 may include pulverized powder obtained by pulverizing the metal oxide and pulverized powder obtained by pulverizing the additive. The additive may be an oxide (e.g., tungsten oxide, copper oxide, nickel oxide, molybdenum oxide, or chromium oxide) including an additive element (e.g., tungsten, copper, nickel, molybdenum, or chromium) different from the metal of the metal oxide (e.g., iron oxide).

Second metal powder 200 in which the first metal powder 100 is agglomerated may be manufactured by agglomerating the first metal powder 100 (S20). The second metal powder 200 may include second metal particles 202, each of which has a diameter of 5 μm to 20 μm.

In some embodiments, the manufacture of the second metal powder 200 may include agglomerating the first metal powder 100 and reducing the first metal powder 100 agglomerated. In some embodiments, the first metal powder 100 may be manufactured into a spherical agglomeration by using a spray dryer, and the spherical agglomeration may be reduced by a thermal treatment to manufacture the spherical second metal particle 202 having a network structure.

For example, when the first metal powder 100 is manufactured by performing a dry ball-milling process on the metal oxide, slurry obtained by mixing the first metal powder 100 and a process control agent (PCA; e.g., methyl alcohol, ethyl alcohol, acetone, or water) may be provided into the spray dryer to manufacture the spherical agglomeration. Alternatively, in certain embodiments, when the first metal powder 100 is manufactured by performing a wet ball-milling process on the metal oxide, a material immediately after the ball-milling process may be provided into the spray dryer to manufacture the spherical agglomeration.

For example, the spherical agglomeration may be reduced in a hydrogen atmosphere at a temperature of 200 degrees Celsius to 800 degrees Celsius. The spherical agglomeration may be thermally treated in the reducing process to bond particles of powder, and thus the second metal particle 202 may have the network structure.

When the first metal powder 100 includes the pulverized powder of the metal oxide and the pulverized powder of the additive, the second metal powder 200 manufactured by agglomerating the first metal powder 100 as described above may be alloy powder of metal obtained by the reduction of the pulverized powder of the metal oxide and the additive element of the additive. In other words, the second metal powder 200 may be compound powder in which the metal and the additive element are chemically combined with each other. For example, when the first metal powder 100 is manufactured by pulverizing iron oxide and nickel oxide, the second metal powder 200 may be alloy powder of iron and nickel.

A first particle having a first diameter and a second particle having a second diameter greater than the first diameter may be agglomerated with each other to form the second metal particle 202 of the second metal powder 200. For example, the first diameter may range from 1 nm to 30 nm, and the second diameter may range from 100 nm to 500 nm. Since the first and second particles having different sizes are agglomerated, a filling efficiency of the second metal particle 202 may be improved.

The second metal powder 200 may be coated with an organic binder (S30). Since the second metal powder 200 is coated with the organic binder, reoxidation of the second metal powder 200 may be minimized and bonding force between particles may be improved.

In some embodiments, the second metal powder 200 may be coated with the organic binder by a wet coating method. In more detail, the coating of the second metal powder 200 with the organic binder may include dissolving the organic binder in a solvent to manufacture a coating solution, providing the coating solution to the second metal powder 200, and drying the second metal powder 200 to remove the solvent. For example, the solvent may be ethyl alcohol, and the organic binder may be stearic acid. In some embodiments, the organic binder may be added at a ratio of 5 vol. % to 10 vol. % with respect to the second metal powder 200.

The second metal powder 200 coated with the organic binder may be agglomerated and coarsened to manufacture third metal powder 300 having higher flowability than the second metal powder 200 coated with the organic binder (S40). In other words, the second metal powder 200 may be agglomerated and coarsened to manufacture the third metal powder 300. A Hausner ratio of the third metal powder 300 may be lower than a Hausner ratio of the second metal powder 200. In some embodiments, the Hausner ratio of the third metal powder 300 may be equal to or less than 1.1 and the Hausner ratio of the second metal powder 200 may be greater than 1.1. The third metal powder 300 may include third metal particles 302, each of which has a diameter of 100 μm to 800 μm.

In some embodiments, the second metal powder 200 may be mechanically mixed so as to be agglomerated. For example, the second metal powder 200 may be mixed by a ball-milling method. A size of the third metal particle 302 of the third metal powder 300 formed by agglomerating the second metal powder 200 may increase as a mechanical mixing time of the second metal powder 200 increases. However, the maximum value of the diameter of the third metal particle 302 may be 800 μm. In other words, the size of the third metal particle 302 may be gradually increased during a certain mechanical mixing time of the second metal powder 200, and the diameter of the third metal particle 302 may be controlled to 800 μm or less after the certain mechanical mixing time.

An aspect ratio of a mixer for mechanically mixing the second metal powder 200 may be great. Thus, a sliding distance of the second metal powder 200 may be sufficiently secured to easily manufacture the third metal powder 300. In some embodiments, the mixer may be charged with the second metal powder 200 of 10 vol. % or less.

As described above, when the second metal powder 200 is the alloy powder of the metal and the additive element, the third metal particle 302 of the third metal powder 300 manufactured by agglomerating the second metal powder 200 may include a compound in which the metal and the additive element are chemically combined with each other. For example, the third metal particle 302 may include a compound ($Fe_3Ni$) of iron and nickel. When the third metal particle 302 includes the compound in which the metal and the additive element are chemically combined with each other, a composition of the third metal particle 302 may be checked by X-ray diffraction analysis.

Alternatively, when the additive is not added in the process of manufacturing the first metal powder 100, additive powder (e.g., tungsten oxide, copper oxide, nickel oxide, molybdenum oxide, chromium oxide, or graphite) including an additive element (e.g., tungsten, copper, nickel, molybdenum, chromium, or carbon) may be added in the operation of agglomerating the second metal powder 200. In more detail, the second metal powder 200 and the additive powder may be mixed with each other and then may be mechanically mixed to manufacture the third metal powder 300. In this case, the third metal particle 302 of the third metal powder 300 may include a mixture in which the metal and the additive element are not combined with each other but are mixed with each other. When the third metal particle 302 includes the mixture in which the metal and the additive element are mixed with each other, a composition of the third metal particle 302 may be checked by X-ray diffraction analysis.

In some embodiments, the third metal powder 300 may be thermally treated. The third metal powder 300 may be thermally treated at a melting point of the organic binder. Thus, agglomeration strength of the third metal particle 302 of the third metal powder 300 may be increased.

Alternatively, in other embodiments, the thermal treatment of the third metal powder 300 may be omitted.

The third metal powder 300 manufactured according to the above embodiments of the inventive concepts may be formed into a molded product through a die molding process and a sintering process. The molded product may be easily manufactured using the third metal powder 300 due to the high flowability and the high moldability of the third metal powder 300.

Evaluation results of characteristics of the metal powder according to the aforementioned embodiments of the inventive concepts will be described hereinafter.

Manufacture of Agglomerated Iron Powder

FIG. 3 shows images for explaining metal powder manufactured by a manufacturing method according to some embodiments of the inventive concepts.

Referring to FIG. 3, $Fe_2O_3$ was prepared as a metal oxide. $Fe_2O_3$ was pulverized by a ball-milling method to manufacture $Fe_2O_3$ powder as first metal powder. Diameters of particles of the $Fe_2O_3$ powder were in a range of 10 nm to 30 nm. The $Fe_2O_3$ powder was mixed with a PCA to manufacture $Fe_2O_3$ powder slurry. The $Fe_2O_3$ powder slurry was injected or provided into a spray dryer at a rate of 2,500 cc/h. Thereafter, an air injection pressure was controlled to 80 kPa to manufacture spherical agglomerations, the spherical agglomerations were reduced by a thermal treatment in a hydrogen atmosphere at 450 degrees Celsius and 550 degrees Celsius for 1 hour, and the reduced and thermal treated agglomerations were coated with an organic binder, thereby manufacturing agglomerated iron powder.

Images (a) and (b) of FIG. 3 show the agglomerated iron powder manufactured by performing the thermal treatment for the reduction at 450 degrees Celsius, and images (c) and (d) of FIG. 3 show the agglomerated iron powder manufactured by performing the thermal treatment for the reduction at 550 degrees Celsius. As shown in FIG. 3, when the thermal treatment for the reduction is performed at 450 degrees Celsius, particles having sizes of 200 nm to 300 nm and particles having sizes of 1 nm to 20 nm are agglomerated with each other. When the thermal treatment for the reduction is performed at 550 degrees Celsius, particles having sizes of 200 nm to 500 nm and particles having sizes of 20 nm to 30 nm are agglomerated with each other.

Change in Size of Coarsened Iron Powder According to Coarsening Process Time

FIG. 4 shows images for explaining a change in size according to an agglomerating process time in a method for manufacturing metal powder according to some embodiments of the inventive concepts.

Referring to FIG. 4, a mixer was charged with the agglomerated iron powder manufactured by the method described with reference to FIG. 3, and then, the agglomerated iron powder was mechanically mixed to manufacture coarsened iron powder as third metal powder. A change in size according to a time was checked while mechanically mixing the agglomerated iron powder. The agglomerated iron powder was formed into primary agglomerations of 1 μm to 5 μm initially, and the primary agglomerations collapsed while being mechanically mixed. Thereafter, spherical coarsened agglomerations were formed by agglomerating force between particles of powder and friction with a wall surface of the mixer.

In addition, as a mechanical mixing time increases, sizes of the agglomerations (i.e., particles) were gradually increased. When the particles were mixed for 5 hours, the particles were coarsened to have sizes ranging from 300 μm to 400 μm. When the particles were mixed for 10 hours, the particles were coarsened to have sizes ranging from 500 μm to 800 μm. In addition, the sizes of the coarsened particles were not beyond 800 μm.

Manufacture of Coarsened Iron Powder According to First and Second Embodiments

The agglomerating process was performed for 5 hours in the method described with reference to FIG. 4, thereby manufacturing the coarsened iron powder according to a first embodiment. The agglomerating process was performed for 10 hours in the method described with reference to FIG. 4, thereby manufacturing the coarsened iron powder according to a second embodiment. To improve agglomeration strength of the coarsened iron powder, the coarsened iron powder was thermally treated for 10 minutes at 70 degrees Celsius similar to a melting point (69 degrees Celsius) of an organic binder. A compression experiment was performed on the coarsened iron powder before and after the thermal treatment, and compressive strength was calculated using the following equation 1. The calculated compressive strengths are shown in the following table 1.

$$S_t=(2.8\times F_t)/(\pi\times d^2) \quad \text{[Equation 1]}$$

($S_t$: compressive strength (MPa), $F_t$: compressive force (mN), $d^2$: diameter (μm) of particle)

TABLE 1

| Classification | Coarsening time (h) | Particle diameter (μm) | Compressive strength (MPa) (Before thermal treatment) | Compressive strength (MPa) (After thermal treatment) |
|---|---|---|---|---|
| First embodiment | 5 | 300~400 | 0.19 | 0.37 |
| Second embodiment | 10 | 500~800 | 0.07 | 0.16 |

As shown in the table 1, the compressive strengths before the thermal treatment of the coarsened iron powder according to the first and second embodiments were 0.19 MPa and 0.07 MPa, respectively, and the compressive strengths after the thermal treatment of the coarsened iron powder according to the first and second embodiments were 0.37 MPa and 0.16 MPa, respectively. As a result, the compressive strengths after the thermal treatment are about two or more times greater than the compressive strengths before the thermal treatment. In other words, the thermal treatment of the coarsened metal powder is an efficiency method that improves the compressive strength of powder to maintain excellent flowability.

Manufacture of Coarsened Mixed Powder According to Third to Fifth Embodiments

To manufacture coarsened mixed powder including a mixture of a metal and an additive element according to embodiments of the inventive concepts, agglomerated iron powder in which iron particles with sizes of 1 nm to 30 nm and iron particles with sizes of 100 nm to 500 nm were agglomerated was prepared, and the agglomerated iron powder was coated with an organic binder.

In a third embodiment of the inventive concepts, graphite powder with a size of 300 nm was mixed with the agglomerated iron powder coated with the organic binder, and then, a coarsening process was performed for 10 hours to manufacture coarsened mixed powder (Fe-0.5 wt % C) according to the third embodiment, in which iron and carbon were mixed with each other.

In a fourth embodiment of the inventive concepts, copper oxide was mechanically milled, and the mechanically milled copper oxide was thermally treated and reduced at 200 degrees Celsius in a hydrogen atmosphere, thereby manufacturing copper powder. The copper powder was mixed with the agglomerated iron powder coated with the organic binder, and then, a coarsening process was performed for 10 hours to manufacture coarsened mixed powder (Fe-10 wt % Cu) according to the fourth embodiment, in which iron and copper were mixed with each other.

In a fifth embodiment of the inventive concepts, nickel oxide was mechanically milled, and the mechanically milled nickel oxide was thermally treated and reduced at 300 degrees Celsius in a hydrogen atmosphere, thereby manufacturing nickel powder. The nickel powder was mixed with the agglomerated iron powder coated with the organic binder, and then, a coarsening process was performed for 10 hours to manufacture coarsened mixed powder (Fe-10 wt % Ni) according to the fifth embodiment, in which iron and nickel were mixed with each other.

TABLE 2

| Classification | Composition |
|---|---|
| Third embodiment | Fe-0.5 wt % C |
| Fourth embodiment | Fe-10 wt % Cu |
| Fifth embodiment | Fe-10 wt % Ni |

FIGS. 5A to 5C show images and X-ray diffraction analysis graphs of coarsened mixed powder manufactured by a method for manufacturing metal powder according to some embodiments of the inventive concepts.

FIGS. 5A to 5C show fine structures and X-ray diffraction analysis graphs of the Fe-0.5 wt % C coarsened mixed powder, the Fe-10 wt % Cu coarsened mixed powder and the Fe-10 wt % Ni coarsened mixed powder, which are manufactured according to the third to fifth embodiments described above.

Referring to FIGS. 5A to 5C, the Fe-0.5 wt % C coarsened mixed powder according to the third embodiment has particle sizes ranging from 500 μm to 700 μm and does not show an oxide phase caused by reoxidation during a process. In addition, the Fe-10 wt % Cu coarsened mixed powder according to the fourth embodiment and the Fe-10 wt % Ni coarsened mixed powder according to the fifth embodiment have particle sizes ranging from 180 μm to 200 μm and do not show the oxide phase caused by reoxidation during a process.

As shown in the X-ray diffraction analysis graphs of FIGS. 5A to 5C, the various additive elements such as carbon, nickel and copper are not chemically combined with iron but are mixed with iron in the powder.

Manufacture of Coarsened Alloy Powder According to Sixth Embodiment

To manufacture coarsened alloy powder including a compound of a metal and an additive element according to embodiments of the inventive concepts, $Fe_2O_3$ was prepared as a metal oxide, and NiO was prepared as an additive. $Fe_2O_3$ and NiO were mixed with each other and were mechanically milled. The milled mixed oxides were spray-dried and then were thermally treated in a hydrogen atmosphere for 1 hour to perform reduction and alloying. Agglomerated Fe—Ni alloy powder was coated with an organic binder, and a coarsening process was performed for 10 hours to manufacture coarsened alloy powder (Fe-10 wt % Ni) including a compound of iron and nickel.

FIG. 6 shows an image and an X-ray diffraction analysis graph of coarsened alloy powder manufactured by a method for manufacturing metal powder according to some embodiments of the inventive concepts.

FIG. 6 shows a fine structure and an X-ray diffraction analysis graph of the Fe-10 wt % Ni coarsened alloy powder manufactured according to the sixth embodiment described above. As shown in FIG. 6, the Fe-10 wt % Ni coarsened alloy powder according to the sixth embodiment has particle sizes ranging from 100 μm to 130 μm and has a Fe phase and a $Fe_3Ni$ alloy phase. In addition, an oxide phase caused by reoxidation during a process is not shown in the Fe-10 wt % Ni coarsened alloy powder according to the sixth embodiment.

As shown in FIG. 6, various additive element such as nickel is chemically combined with iron to form the compound, and the compound exists in the powder.

Flowability Evaluation

To evaluate flowability of the coarsened iron powder manufactured according to the first and second embodiments described above, a Hausner ratio was calculated using the following equation 2. The Hausner ratio is a criterion for evaluating the flowability and has a value of 1 or more. As the Hausner ratio becomes closer to 1, the flowability becomes better.

$$\text{Hausner Ratio}=\rho T/\rho B \qquad \text{[Equation 2]}$$

(ρT: Tap density, ρB: Bulk apparent density)

The Hausner ratios calculated using the equation 2 are shown in the following table 3. In more detail, the following table 3 shows the Hausner ratios of the coarsened iron powder according to the first and second embodiments, a Hausner ratio of general iron nano powder not coarsened according to a first comparative example, a Hausner ratio of a Co-based alloy for 3D printing which is currently on the market according to a second comparative example, and a Hausner ratio of a Fe-based alloy for 3D printing which is currently on the market according to a third comparative example.

TABLE 3

| Classification | Coarsening time (h) | Size (μm) | Bulk density (% T.D.) | Tap density (% T.D.) | Hausner ratio |
|---|---|---|---|---|---|
| First embodiment | 5 | 300~400 | 61.41 (28.25) | 64.48 (29.66) | 1.05 |
| Second embodiment | 10 | 500~800 | 62.98 (28.97) | 65.22 (30.00) | 1.03 |
| First comparative example | — | 1~5 | (12.54) | (24.73) | 1.97 |
| Second comparative example | — | 5~70 | 50.95 | 56.63 | 1.11 |
| Third comparative example | — | 5~10 | 58.28 | 66.71 | 1.14 |

As shown in the table 3, the Hausner ratio of the iron nano powder according to the first comparative example is 1.97 and has the lowest flowability. In addition, the Hausner ratios of the coarsened iron powder according to the first and second embodiments are lower than the Hausner ratios of the alloy powder for 3D printing currently on the market according to the second and third comparative examples. In other words, the coarsened metal powder according to embodiments of the inventive concepts may be easily used as powder for 3D printing, due to the high flowability thereof.

Molding Density Evaluation

FIG. 7 is a graph showing measured molding densities of metal powder according to some embodiments of the inventive concepts.

Referring to FIG. 7, the coarsened iron powder according to the second embodiment described with reference to FIG. 4 and the table 1 was prepared. In a fourth comparative example, iron particles of an average size of 50 nm were irregularly agglomerated to manufacture iron powder including particles with sizes ranging from 5 μm to 200 μm. In a fifth comparative example, iron particles with sizes ranging from 1 nm to 30 nm and iron particles with sizes ranging from 100 nm to 500 nm were agglomerated to manufacture iron powder including particles with sizes ranging from 1 μm to 5 μm.

TABLE 4

| Classification | Iron powder |
|---|---|
| Second embodiment | Coarsened iron powder including particles of 500 μm to 800 μm |
| Fourth comparative example | Iron powder including particles of 5 μm to 200 μm manufactured by irregularly agglomerating iron particles of 50 nm |
| Fifth comparative example | Iron powder including particles of 1 μm to 5 μm manufactured by agglomerating iron particles of 1 nm to 30 nm and iron particles 100 nm to 500 nm |

A molded product was manufactured using the iron powder according to each of the second embodiment, the fourth comparative example and the fifth comparative example, and a molding density according to molding pressure was measured. As shown in FIG. 7, the molding density of the molded product manufactured using the iron powder according to the fourth comparative example has the lowest values. In addition, the molded product manufactured using the iron powder according to the second embodiment and the molded product manufactured using the iron powder according to the fifth comparative example have substantially the same molding densities. In other words, the coarsened iron powder according to embodiments of the inventive concepts has both the high moldability and the high flowability.

A method for manufacturing an injection molded body using feedstock according to embodiments of the inventive concepts and a method for manufacturing feedstock for powder injection molding will be described hereinafter.

Some embodiments of the inventive concepts relate to feedstock for powder injection molding in order to manufacture ultra-small parts of 1 mm or less. To manufacture the ultra-small parts, injection molding may be performed at a low temperature of 60 degrees Celsius to 100 degrees Celsius and a low pressure of 4 MPa or less.

In a conventional art, a binder of a polymer organic material is used. However, the conventional binder may cause a moldability problem in the low-temperature and low-pressure powder injection molding.

Therefore, the inventors of the present invention recognized that injection molding could be performed at a low temperature and a low pressure by using a wax-based binder having a low melting point and a low viscosity as a binder material and by using sub-micron powder. As a result, the inventors of the present embodiments came to embodiments of the inventive concepts.

The feedstock for powder injection molding according to embodiments of the inventive concepts may include raw material powder and a wax-based binder.

The raw material powder is not limited to a specific kind, but any material capable being molded may be applied to the raw material powder. For example, the raw material powder may include a metal or ceramic. In particular, the metal may be, but not limited to, a Fe-based metal, a W-based metal, or a Cu-based metal.

The raw material powder may include micron powder of 1 μm or more and sub-micron powder with a size of several nm to 1 μm. In other embodiments, the raw material powder may consist of only the sub-micron powder. Hereinafter, the sub-micron powder may be referred to as 'a nano powder'.

When a fine structure of the feedstock including the micron powder and the sub-micron powder mixed with each other is observed after molding and degreasing, the sub-micron powder surrounds the micron powder. At this time, the sub-micron powder acts as a binder. In other words, the sub-micron powder may fill a gap between particles of the micron powder to act as the binder.

Meanwhile, the feedstock including the sub-micron powder and the wax-based binder may have relatively high bonding force between particles due to wide surface areas of the particles to secure excellent moldability.

An average particle diameter of the micron powder may range from 1 μm to 10 μm. These may correspond to sizes of powder applied to a normal powder injection molding technique. An average particle diameter of the sub-micron powder may range from 50 nm to 200 nm. This may be because particles having sizes in this range can effectively fill the gap of the micron powder. Here, the term 'effective' may mean that a stacking rate can be maximized in mixing of the micron powder and the sub-micron powder and that the sub-micron powder can act as a solid binder in mixing with a binder in a subsequent process. In particular, the term 'effective' may mean that the sub-micron powder has excellent sintering characteristics at a low temperature.

When the sub-micron powder having sub-micron sizes is mixed with the micron powder, the sub-micron powder may be added at a volume percent (vol. %) ranging from 5 vol. % of a total volume of the raw material powder to a porosity of the micron powder. At this time, an addition amount of the sub-micron powder may be varied according to a size of the sub-micron powder. In particular, a content of the sub-micron powder may be 10 vol. % or more in order that the sub-micron powder fills the gap of the micron powder and has torque stability.

Embodiments of the inventive concepts include the wax-based binder. The wax-based binder may have the low melting point and the low viscosity, and thus the wax-based binder can be injection-molded at a low pressure. The wax-based binder is not limited to a specific kind. For example, the wax-based binder may have the melting point lower than 80 degrees Celsius. For example, the wax-based binder may include a paraffin-based wax and/or may use beeswax or canauba wax.

In some embodiments, for example, stearic acid (an example) corresponding to a surfactant having a melting point lower than 80 degrees Celsius may be added to prevent a separation phenomenon between the raw material powder and the binder wax, along with the wax-based binder. Substantially, the stearic acid can exhibit a surfactant characteristic at a level of 5%. A mixing ratio (a volume ratio) of the stearic acid:the wax-based binder may range from 1:2 to 1:20.

According to embodiments of the inventive concepts, since one kind of the binder (i.e., the wax-based binder) or two kinds of the binders (i.e., the wax-based binder and the stearic acid) is/are applied, a degreasing process of removing a binder after final molding may be simpler than a conventional degreasing process of removing three, four or five kinds of binders. In addition, a secondary process such as a solvent extraction process can be omitted, and thus the efficiency of the manufacturing process may be improved.

The wax-based binder may deteriorate moldability due to its low viscosity. However, according to embodiments of the inventive concepts, the nano powder is added to solve this problem.

Meanwhile, a content of entire metal powder to entire feedstock may range from 50 vol. % to 80 vol. %. If the content of the entire metal powder is less than 50 vol. %, a relative amount of the binder may be great too to deteriorate moldability. If the content of the entire metal powder is greater than 80 vol. %, the amount of the powder may be great too to excessively increase process temperature and pressure and to cause non-uniform mixture.

A method for manufacturing feedstock according to embodiments of the inventive concepts will be described hereinafter in detail.

The feedstock used in low-temperature and low-pressure powder injection molding according to embodiments of the inventive concepts may be manufactured through a process of preparing the raw material powder and the wax-based binder and a process of mixing and stirring the raw material powder and the wax-based binder. The mixing and stirring process is not limited to a specific process condition. For example, the mixing and stirring process may be performed at 70 degrees Celsius and at a rotational rate of about 60 rpm.

The feedstock manufactured as described above may be injection-molded to form a molded body, and then, a degreasing process may be performed on the molded body. In these processes, a portion of the nano powder may be sintered while removing the binder and the surfactant, and a shape of the molded body may be maintained due to the sintering of the nano powder. At this time, a temperature of the degreasing process may be adjusted according to the size of the nano powder.

After the degreasing process, the molded body may be thermally treated at about 1000 degrees Celsius or more for several hours to sinter the entire powder. Thus, a sintered body may be formed.

Hereinafter, embodiments of the inventive concepts will be described in detail. The following embodiments are provided only to disclose the inventive concepts and let those skilled in the art know the category of the inventive concepts. In other words, it should be noted, however, that the inventive concepts are not limited to the following exemplary embodiments and may be implemented in various forms.

[Seventh Embodiment] Mixed Powder of Fe Micron Powder and Fe Sub-Micron Powder 1. Manufacture of Feedstock Raw material metal powder used to manufacture initial feedstock included spherical micron-sized Fe carbonyl powder and Fe nano powder, and fine images thereof were shown in (a) and (b) of FIG. 8. At this time, a volume fraction of an addition amount of the nano powder to the micron-sized Fe powder was changed in the order of 3%, 10%, and 25%, and feedstock having only micron powder without the nano powder was prepared as a control group. The Fe carbonyl powder has an average size of 4 and the Fe nano powder has an average size of 100 nm.

Paraffin wax having a low viscosity characteristic among structural binders was used as a binder to considerate friction of the nano powder and to increase a flowability characteristic of the feedstock. In addition, stearic acid corresponding to a surfactant was added to prevent a separation phenomenon between the powder and the binder. Here, a mixing composition of the paraffin wax and the stearic acid was fixed to a volume ratio of 3:1. The mixing of the prepared mixture of the powder and the binder was performed at 60 rpm and 70 degrees Celsius by a stirrer, and then, injection molding was performed at 70 degrees Celsius and 1 MPa in consideration of the viscosity and the melting point of the feedstock.

FIG. 9 shows images of fine structures of the feedstock formed of only the micron powder and the feedstock containing the Fe nano powder of 25%. Images (a) and (b) of FIG. 9 show the feedstock formed of only the micron powder. The image (a) shows a case in which a powder content is 50 vol. %, and the image (b) shows a case in which a powder content is 69 vol. %. Images (c) and (d) of FIG. 9 show the feedstock including the Fe nano powder of 25% with respect to the micron powder. Here, powder contents with respect to the binder in the image (c) and (d) are the same as those in the images (a) and (b).

As shown in the images (c) and (d) of FIG. 9, in the case in which the nano powder is mixed in the feedstock, a distribution of the powder and binder is substantially uniform even though the powder content of the feedstock is about 69%. In addition, the feedstock including the nano powder has a dense fine structure without pores.

Images (a), (b), (c), and (d) of FIG. 10 show the feedstock containing the Fe nano powder of 0%, the feedstock containing the Fe nano powder of 3%, the feedstock containing the Fe nano powder of 10%, and the feedstock containing the Fe nano powder of 25%, respectively. Bonding strength is checked through a shape of the feedstock. In other words, a size of an agglomeration increases as the content of the Fe nano powder increases to 25%, and thus it is recognized that the bonding strength increases.

2. Powder Injection Molding

Injection molding was performed using the feedstock including the Fe nano powder of 25% at 70 degrees Celsius and 1 MPa, thereby manufacturing an injection molded part. The injection molded part was shown in images (a) and (b) of FIG. 11, and a destruction surface of the injection molded part was shown in an image (c) of FIG. 11. As shown in the image (c) of FIG. 11, the micron powder, the nano powder, and the binder are uniformly distributed in the molded part, and the molded part has a dense structure without pores.

3. Degreasing Process

A degreasing process was performed after the injection molding was performed using the feedstock to which the Fe nano powder of 25% was added. The degreasing process was performed based on a temperature-time graph (a) of FIG. 12, and an image of a fine structure of a molded body after the degreasing process was shown in images (b) of FIG. 12.

As shown in the images (b) of FIG. 12, shape stability of the molded body after the degreasing process is excellent. As a result of analysis of the fine structure, the nano powder surrounded the micron powder to form a neck corresponding to a result of initial sintering, and thus the structure of the molded body was maintained even though the binder was completely removed at a low temperature. In other words, the moldability was excellent without a polymer organic binder.

Compression destruction strength of the molded body after the degreasing process was measured. Images (c) of FIG. 12 show results of a compression destruction test after the degreasing process of the molded body manufactured using the micro-nano mixed powder, and images (d) of FIG. 12 show results of a compression destruction test after the degreasing process of the molded body manufactured using only the micron-sized powder. A graph (e) of FIG. 12 shows compression destruction strength of the molded body after the degreasing process. As shown in the images (c) and (d) of FIG. 12, when the molded body is manufactured using the micro-nano mixed powder, the destruction of a specimen proceeds in a compressive direction without influence of density gradient and residual stress. On the contrary, when the molded body is manufactured using the micron-sized metal powder, interlaminar destruction occurs in the molded body by density gradient and residual stress which occur in a single-axis bi-directional molding process.

The graph (e) of FIG. 12 shows the compression destruction strength of the molded body after the degreasing process. The destruction strength of the molded body formed of only the micron-sized metal powder is about 1.3 MPa. On the contrary, the destruction strength of the molded body formed of the mixed powder of the micron-sized metal powder and the nano-sized metal powder is about 9 MPa and is about 8 times greater than the destruction strength of the molded body formed of only the micron-sized metal powder. As a result, the initial sintering of the nano powder may occur through the degreasing process of 500 degrees Celsius or less, and thus strength of the molded body may be increased.

4. Sintering Process

The molded body after the degreasing process was sintered at 1250 degrees Celsius for 3 hours to manufacture a molded part, and the molded part was shown in FIGS. 13 and 14. An image (c) of FIG. 13 shows a fine structure of the sintered body. As shown in the image (c) of FIG. 13, the sintered body has a density of 95% T.D. (true density). Meanwhile, reference designators (a) and (b) of FIG. 14 show an image and a measured surface roughness of the molded part. As shown in FIG. 14, the surface roughness of the molded part manufactured using the feedstock including the Fe nano powder of 25% is about three times greater than the surface roughness of the molded part manufactured using the feedstock not including the Fe nano powder.

On the other hand, FIG. 15 is a graph showing a change behavior of torque in mixing of feedstock. A graph (a) of FIG. 15 shows a case of micron powder, a graph (b) of FIG. 15 shows a case of micron-3 vol. % nano mixed powder, a graph (c) of FIG. 15 shows a case of micron-10 vol. % nano mixed powder, and a graph (d) of FIG. 15 shows a case of micron-25 vol. % nano mixed powder.

Mixing torque means torque that occurs in a mixer on the basis of a viscosity of a mixture when powder and a binder are mixed with each other.

In a case in which the low-viscosity binder system of embodiments of the inventive concepts is applied to the feedstock consisting of only the micron powder, the torque corresponding to the viscosity does not occur since particles of the powder are not bonded to each other.

Since the sub-micron powder is added, the viscosity of the feedstock increases, and thus the torque can be measured. In addition, behavior of stabilization after a torque peak, in which uniformity of the powder and the binder can be expected, is repeatedly shown. In addition, this behavior occurs until the content of the powder in the feedstock reaches about 70%. This means that the powder content of the feedstock can be effectively increased. In other words, the low-viscosity and low-melting point binder system for reducing the temperature and pressure of the powder injection molding process may be effected by the addition of the nano powder.

[Eighth Embodiment] Only Sub-Micron Powder

Paraffin wax and stearic acid binder were mixed with each other at a mixing ratio of 3:1, and then, the mixture of the paraffin wax and the stearic acid binder was mixed with W—Cu nano powder having an average particle diameter of about 200 nm, thereby manufacturing feedstock. At this time, a powder content of the feedstock was about 50 vol. %, and a fine structure thereof was shown in FIG. 16. As shown in FIG. 16, the nano powder was uniformly mixed with the binder.

Injection molding was performed using the feedstock through a mass-injection molding apparatus, and a molded body obtained by the injection molding was shown in an image (a) of FIG. 17. The molded body was degreased through a stepwise temperature rising process which was maintained at 200 degrees Celsius and and 600 degrees Celsius, and the degreased molded body was shown in images (b) and (c) of FIG. 17. As shown in FIG. 17, even though the degreasing process is performed at low temperature, a portion of the nano powder is sintered to stably maintain the shape of the specimen, and the molded body after degreasing is formed of only fine nano powder.

After the degreasing process, the molded body was sintered at 1350 degrees Celsius for about 3 hours, and the sintered body was shown in an image (a) of FIG. 18, and a fine structure of the sintered body was shown in images (b) of FIG. 18. As shown in FIG. 18, the W—Cu sintered body has a substantially completely dense structure of 98% T.D., and a size of a crystal grain of the W—Cu sintered body is about 5 μm.

[Ninth Embodiment] Mixed Powder of Stainless Steel (SUS 316L) Micron Powder and Nano Powder 1. Manufacture of Feedstock As shown in an image (a) of FIG. 19, micron SUS 316L powder having an average particle size of 4 μm was manufactured by a water atomizing method. As shown in an image (b) of FIG. 19, nano SUS 316L powder having an average particle size of 100 nm was manufactured by a pulsed wire evaporation method. The micron SUS 316L powder was mixed with the nano SUS 316L powder. A mixing ratio of the micron powder:the nano powder was 75 vol. %:25 vol. %. Feedstock composed of only the micron SUS 316L powder was prepared as a control group.

Here, paraffin wax and stearic acid binder were mixed with each other at a mixing ratio of 3:1 to prepare a binder.

Thereafter, the mixed SUS 316L powder and the binder were mixed with each other. Here, a content of the SUS 316L powder was 66 vol. %, and a mixing temperature was 70 degrees Celsius. As a result, feedstock was manufactured. As shown in graphs (a) and (b) of FIG. 20, an optimum content of powder in the feedstock ranges from 66 vol. % to 70 vol. %. As shown in the graph (b) of FIG. 20, the maximum content of the powder is about 71 vol. %. Meanwhile, an experiment was performed while increasing the content of the powder, and results of the experiment were shown in images (a) to (f) of FIG. 21. The image (a) of FIG. 21 shows a case of the powder content of 50 vol. %, the image (b) of FIG. 21 shows a case of the powder content of 54 vol. %, the image (c) of FIG. 21 shows a case of the powder content of 58 vol. %, the image (d) of FIG. 21 shows a case of the powder content of 62 vol. %, and the image (e) of FIG. 21 shows a case of the powder content of 66 vol. %. The image (f) of FIG. 21 is an enlarged view of the image (e). As shown in FIG. 21, as the powder content increases in the mixing process, the distribution of the binder and the powder becomes uniform to obtain a dense structure not having pores. In addition, a filling efficiency is increased or improved by the nano powder.

2. Powder Injection Molding

Powder injection molding was performed on the feedstock including the mixed SUS 316L powder of 66 vol. % at 70 degrees Celsius and 1 MPa.

FIG. 22 shows a gear-shaped part and a tensile specimen, which correspond to injection molded bodies, and fine structures thereof. As shown in a surface image of the gear part, nano-sized particles are uniformly distributed between micron-sized particles. In addition, an image of a destruction surface of the tensile specimen also shows a uniform and dense structure.

3. Degreasing Process

A degreasing process was performed on the injection molded body in a hydrogen atmosphere through stepwise temperature-rising and maintaining operations. A mass of the molded body was reduced by 5.33% due to the degreasing process. The reduced amount is substantially equal to the amount (5.4 wt %) of the initially added binder within a tolerance. As a result, it is recognized that the binder in the molded body was completely removed by the degreasing process.

4. Sintering Process

The degreased molded body was sintered at 1350 degrees Celsius for 3 hours in a low-vacuum Ar atmosphere.

FIG. 23 shows images of the micron powder sintered body of the control group and the micron-nano powder sintered body of the present embodiment, which were sintered under the conditions described above. The structure of the micron-nano powder sintered body according to the present embodiment is more uniform and finer than the structure of the micron powder sintered body according to the control group.

Various physical properties of the sintered body obtained by the sintering process were measured. The following table 5 shows measurement results of physical properties of the sintered body obtained after sintering the mixture of the micron powder and the nano powder according to the present embodiment, measurement results of physical properties of a sintered body manufactured using commercial micron feedstock, and measurement results of physical properties of a sintered body manufactured using micron feedstock disclosed in a document.

TABLE 5

(Comparison table of physical properties of sintered body according to constituent particle)

| Specimen classification | Average crystal grain | Vicker's hardness | Tensile strength | Yield strength | Elongation |
|---|---|---|---|---|---|
| Micron-nano | <50 mm | 175 | 560 MPa | 235 MPa | 41% |
| Micron (commercial) | >70 mm | 129 | 488 MPa | 200 MPa | 32% |
| Micron (Document) | — | 140 | 510 MPa | 220 MPa | 45% |

The commercial micron feedstock shown in the table 5 is a feedstock product for SUS316L powder injection of Rapidus company (currently, Koran PIM), which includes wax and polymer resin as a binder. The document was quoted from 80 pages of "Powder Injection Molding—Design and Applications" (Randall M. German, Innovative Material Solutions, Inc.) and used a feedstock product for SUS316L powder injection.

As shown in the table 5, the sintered body including the micron powder and the nano powder mixed with each other has high hardness, tensile strength and yield strength, unlike the cases having only the micron powder (the document and the commercial micron powder). In addition, the sintered body including the micron powder and the nano powder also has excellent elongation.

A density of a sintered body manufactured by a conventional powder process is about 95% and is lower than that of a material manufactured by another general process. This may be because pores of about 5% exist. However, according to embodiments of the inventive concepts, since the nano powder is added, the density of the sintered body increases to about 98% or more. Thus, the absolute amount of pores and defects is small in the sintered body. As a result, the sintered body according to embodiments of the inventive concepts has the excellent physical properties including the high elongation.

The metal powder and the feedstock according to embodiments of the inventive concepts may be used to manufacture various molded products (e.g., parts and materials) by using a method such as a powder metallurgy method.

According to embodiments of the inventive concepts, the first metal powder may be agglomerated to manufacture the second metal powder, and the second metal powder may be coated with the organic binder. The second metal powder coated with the organic binder may be agglomerated and coarsened to manufacture the third metal powder with the improved flowability and moldability.

In addition, according to some embodiments of the inventive concepts, since the organic material having the low melting point and the low viscosity and the sub-micron powder are used as the binder material of the feedstock, the powder injection molding (PIM) can be performed at low temperature and low pressure, and sufficient bonding strength may be secured even though the sintering of the powder is performed at low temperature. Thus, the degreasing process can be performed at low temperature.

While the inventive concepts have been described with reference to exemplary embodiments, it will be apparent to those skilled in the art that various changes and modifications may be made without departing from the spirits and scopes of the inventive concepts. Therefore, it should be understood that the above embodiments are not limiting, but illustrative. Thus, the scopes of the inventive concepts are to be determined by the broadest permissible interpretation of the following claims and their equivalents, and shall not be restricted or limited by the foregoing description.

What is claimed is:

1. A method for manufacturing metal powder, the method comprising:

pulverizing iron oxide to produce a first powder comprising particles having a diameter in the range of 10 nm to 30 nm;

adding a process control agent to the first powder to produce a powder slurry;

providing the powder slurry into a dryer;

manufacturing spherical agglomerations of iron oxide by controlling an air injection pressure to the dryer;

thermally treating the spherical agglomerations of iron oxide at between 450° C. and 550° C. to reduce the spherical agglomerations to manufacture a second powder;

coating the second powder with an organic binder, thereby producing a coated second powder having a first flowability;

providing the coated second powder into a mechanical mixer;

agglomerating and coarsening the coated second powder in the mechanical mixer for a mixing time between 5 hours and 10 hours to manufacture a third powder comprising particles having a diameter between 100 μm and 800 μm; and after manufacturing the third powder, increasing a flowability of the third powder to a point that is greater than the first flowability.

2. The method of claim 1, further comprising: thermally treating the third powder to increase agglomeration strength of the third powder.

3. The method of claim 2, wherein the third powder is thermally treated at a melting point of the organic binder.

4. The method of claim 1, wherein a particle size of the third powder increases as a time that the coated second powder is mechanically mixed increases.

5. The method of claim 1, wherein a Hausner ratio of the third powder is 1.1 or less.

6. The method of claim 1, wherein the third powder comprises particles having a diameter between 500 μm and 800 μm.

* * * * *